US010443283B2

(12) United States Patent
Seiling et al.

(10) Patent No.: US 10,443,283 B2
(45) Date of Patent: Oct. 15, 2019

(54) SINGLE HUNG WINDOW CONSTRUCTION WITH AN UPPER FIXED LITE OF GLASS AND A MOVABLE BOTTOM SASH BEING GENERALLY COPLANAR

(71) Applicant: VEKA INC., Fombell, PA (US)

(72) Inventors: Kevin A. Seiling, Monaca, PA (US); William G. Roberts, Beaver Falls, PA (US)

(73) Assignee: VEKA, INC., Fombell, PA (US)

( * ) Notice: Subject to any disclaimer, the term of this patent is extended or adjusted under 35 U.S.C. 154(b) by 216 days.

(21) Appl. No.: 15/637,359

(22) Filed: Jun. 29, 2017

(65) Prior Publication Data

US 2019/0003228 A1 Jan. 3, 2019

(51) Int. Cl.
*E05D 15/22* (2006.01)
*E06B 3/50* (2006.01)

(52) U.S. Cl.
CPC ..... *E05D 15/22* (2013.01); *E06B 3/5063* (2013.01); *E06B 3/5018* (2013.01)

(58) Field of Classification Search
CPC ..... E05D 15/22; E05D 15/20; E06B 3/5063; E06B 3/4407
See application file for complete search history.

(56) References Cited

U.S. PATENT DOCUMENTS 1,441,673 A * 1/1923 Fiola ..... E06B 3/50 49/128
1,533,048 A * 4/1925 Sustarsic ..... E06B 3/50 454/217
1,621,851 A * 3/1927 Minich ..... E06B 3/50 49/129
1,636,806 A * 7/1927 Campbell ..... E06B 3/44 49/128
1,854,419 A * 4/1932 Neuhausen ..... E06B 3/50 49/129
2,026,119 A * 12/1935 Benzenberg ..... E06B 3/50 49/129
2,169,343 A * 8/1939 Kaul ..... E06B 3/4423 126/190
2,207,772 A * 7/1940 Axe ..... E06B 3/44 49/418
2,266,076 A * 12/1941 Reynolds ..... E06B 3/50 49/155
2,289,960 A * 7/1942 Grignet ..... E06B 3/44 49/129

(Continued)

FOREIGN PATENT DOCUMENTS

WO WO03104598 A1 12/2003

*Primary Examiner* — Justin B Rephann
(74) *Attorney, Agent, or Firm* — Eckert Seamans Cherin & Mellott, LLC; Arnold B. Silverman

(57) ABSTRACT

A single hung window has a window frame, an upper fixed lite of glass secured to the window frame and a movable lower sash secured to the window frame with the lower sash being generally coplanar with the upper fixed lite of glass. Lower sash retention elements secured to opposed jamb portions are operatively associated with the lower sash to facilitate securement of the lower sash in a plurality of positions. A balance system is secured within each jamb and is operatively associated with said lower sash. The lower sash may be structured to receive a screen. The sash may be employed alone without the upper fixed lite of glass.

31 Claims, 39 Drawing Sheets

(56) References Cited

U.S. PATENT DOCUMENTS 2,317,312 A * 4/1943 Swanson ..... E06B 3/4627 292/347
2,564,299 A * 8/1951 Coughenour ..... E06B 3/50 49/407
2,598,817 A * 6/1952 Mohring ..... E05D 15/00 16/268
2,908,052 A * 10/1959 Jakush ..... E06B 3/50 49/129
3,694,959 A * 10/1972 Gartner ..... E06B 3/44 49/128
4,324,072 A * 4/1982 Sterner, Jr. ..... E05D 15/0604 49/129
4,570,381 A * 2/1986 Sterner, Jr. ..... E05D 15/20 49/129
4,924,930 A * 5/1990 Drennan ..... E05D 15/20 160/371
5,592,781 A * 1/1997 Mauro ..... E05B 65/0835 49/161
5,675,937 A 10/1997 Stebel
6,216,392 B1 4/2001 DiGinosa
6,679,001 B1 1/2004 Guelck
6,988,334 B2 * 1/2006 Kinsey ..... E05D 15/22 49/187
7,111,430 B2 9/2006 Kinsey
7,210,267 B2 5/2007 Versteeg et al.
7,571,568 B2 8/2009 Ito et al.
8,132,369 B2 3/2012 Pettit et al.
9,109,386 B2 8/2015 Deboer
2003/0150165 A1 * 8/2003 Ronay ..... E05D 15/0608 49/127
2010/0115845 A1 * 5/2010 Lago Palacios .... E05D 13/1253 49/128
2011/0011002 A1 * 1/2011 Guillemette ..... E06B 3/44 49/394
2012/0117882 A1 * 5/2012 Guillemette ..... E06B 3/5018 49/156
2012/0297687 A1 * 11/2012 Baker ..... E05D 13/1276 49/414
2013/0318875 A1 * 12/2013 Hansen ..... E05F 15/665 49/349
2014/0007509 A1 * 1/2014 Hulst ..... B60J 1/17 49/404
2016/0123048 A1 5/2016 Sofianek et al.
2016/0138317 A1 * 5/2016 deNormand ..... E05D 15/22 49/161

* cited by examiner

SINGLE HUNG WINDOW CONSTRUCTION WITH AN UPPER FIXED LITE OF GLASS AND A MOVABLE BOTTOM SASH BEING GENERALLY COPLANAR

BACKGROUND OF THE INVENTION

1. Field of the Invention

The present invention relates to a single hung window with an upper fixed lite of glass and a movable lower sash. The movable lower sash underlies the upper fixed lite of glass. The lower sash in closed position is generally coplanar with the upper fixed lite of glass. The movable sash may be employed without the upper fixed lite.

2. Description of the Prior Art

It has been well known in prior art, single hung windows as well as double hung windows to have the lower sash offset with respect to the upper fixed lite of glass. See, for example, U.S. Pat. Nos. 6,216,392 and 7,571,568.

U.S. Pat. No. 7,111,430 discloses a slideable and tiltable window which employs tilt control bars to hold the sashes in their respective tilted positions. Pins and spring locks are slideably received within the frame channels of the respective upper and lower sashes.

It has also been known to provide windows which are tiltable and/or slideable and are provided with locks to secure the windows in a desired position. See, for example, U.S. Pat. Nos. 6,679,001 and 8,132,369.

U.S. Pat. No. 5,675,937 discloses a tilt assist device which employs a flexible jamb liner which is said to facilitate interior tilting.

U.S. Pat. No. 9,109,386 discloses a window sash counterbalance having an assist mechanism.

U.S. Pat. No. 7,210,267 discloses a double-hung, tilt-out window assembly which employs a slide block between a side member of the frame and the lower sash. Pivots are provided and/or supported by the slide block so as to facilitate tilting of the sash about a horizontal axis.

U.S. Published Patent Application 2016/0123048 discloses a pivot bar for tiltable window sashes. The tilt latch is structured to be retracted from the window jambs and allow the lower sash to pivot about the pivot bars.

PCT Publication WO 03/104,598 discloses a sliding sash window having a sealing strip and associated structural elements to resist entry of wind-driven rain into the window structure. Tilt limiting rods are also disclosed.

While the foregoing prior art discloses various embodiments of single hung and double hung windows which may provide for tilting and/or sliding sash movement as well as locking elements, there is lacking a disclosure of a single hung window having the overlying upper fixed lite of glass with the underlying movable sash disposed generally within the same plane. There is also lacking the various improvements associated with the present invention resulting from the generally coplanar sash construction.

SUMMARY OF THE INVENTION

A single hung window has a window frame, an upper fixed lite of glass secured to the window frame and a movable lower sash secured to the window frame with the lower sash being generally coplanar with the upper fixed lite of glass. Lower sash retention elements secured to opposed jamb portions are operatively associated with the lower sash to facilitate securement of the lower sash in a plurality of positions. The lower sash may be moved to a closed position, a vent opening position, a vertically elevated open position and internally rotated to facilitate cleaning of the exterior surface of the sash from the building interior. A balance system is secured within each jamb and is operatively associated with said lower sash. The lower sash may be structured to receive a screen. The sash may be employed alone without the upper fixed lite of glass.

It is an object of the present invention to provide a single hung window wherein when in closed position the movable sash is generally coplanar with the overlying immovable upper fixed lite of glass.

It is a further object of the present invention to provide such a construction wherein the movable sash is structured to slide in a generally vertical path sash open position or to be tilted to create a vent opening.

It is yet another object of the present invention to provide such a single hung window which has reduced total frame thickness as a result of the relative positions of the movable sash and the overlying upper fixed lite of glass.

It is yet another object of the present invention to provide a compression seal which resists air infiltration and entry of other undesired foreign matter.

It is yet another object of the present invention to provide a compression seal which may be coextruded onto the sash or frame thereby enhancing manufacturing efficiency and eliminating the need for one or more separate elements.

It is yet another object of present invention to provide a sash locking feature which may eliminate the need for tilt latches or a keeper.

It is yet another object of the present invention to provide a balance system for the lower sash.

It is another object of the present invention to provide a single hung window which as a result of reduced frame thickness employs less material and, therefore, reduces cost.

It is a further object of the invention which provides for a full screen track permitting a screen to slide upward and out of the way, as contrasted with prior art single hung screens which are installed under the fixed meeting rail.

It is a further object of the invention to provide a single hung window with a lower sash which is structured to be retained in multiple positions with one position facilitating cleaning of the outer surface of the window from the interior of the building.

It is a further object of the present invention to provide a window construction which is interiorly glazed to allow for ease of glass replacement from inside of the building.

It is yet another object of the present invention to provide a single hung window that has an inner plane and an outer plane which affords easy colorization with capstocks, paints and laminates.

It is another object of the present invention to provide a movable sash structured to be retained in multiple positions without the presence of an overlying upper fixed lite of glass.

These and other objects will be more fully understood from the following detailed description of the invention on reference to the illustrations appended hereto.

BRIEF DESCRIPTION OF THE DRAWINGS

FIG. 7 (*b*) shows a perspective view of the window in the position of FIG. 7(*a*) taken from the building interior.

FIG. 7(*c*) is a left elevational view showing the window of FIGS. 1 through 6 with the sash in the full open position.

FIG. 15 (*b*) shows a cross-sectional illustration a portion of the lower sash 8 with portions of the balance system.

FIG. 23(*b*) is a perspective view taken from the building interior showing the sash 8 in vent position with the sash retention elements engaging the sash.

FIG. 23 (*c*) is a perspective view taken from the building interior showing the sash retention element out of engagement with the sash to allow inward tilting for cleaning.

FIG. 25 (*c*) is an elevational view showing the window of FIGS. 25 (*a*) and 25 (*b*).

FIG. 26 (*b*) is a front elevational view of the retention assembly of FIG. 26(*a*).

FIG. 26 (*c*) is a right hand elevational view of the retention assembly of FIG. 26 (*a*).

FIG. 26 (*d*) is a left hand elevational view of the retention assembly of FIG. 26 (*a*).

FIG. 26 (*e*) is a top plan view of the retention assembly of FIG. 26 (*a*).

FIG. 26 (*f*) is a bottom plan view of the retention assembly of FIG. 26 (*a*).

FIG. 35(*b*) shows a cross-sectional view of the jamb and sash and shows additional details of FIG. 35 (*a*).

FIG. 54 (*b*) is a detail of the seal 234 which is received within sill insert 230.

FIG. 56 (*b*) shows a cross-section of a fiberglass pultruded jamb frame.

DESCRIPTION OF THE PREFERRED EMBODIMENTS

Figure 2:
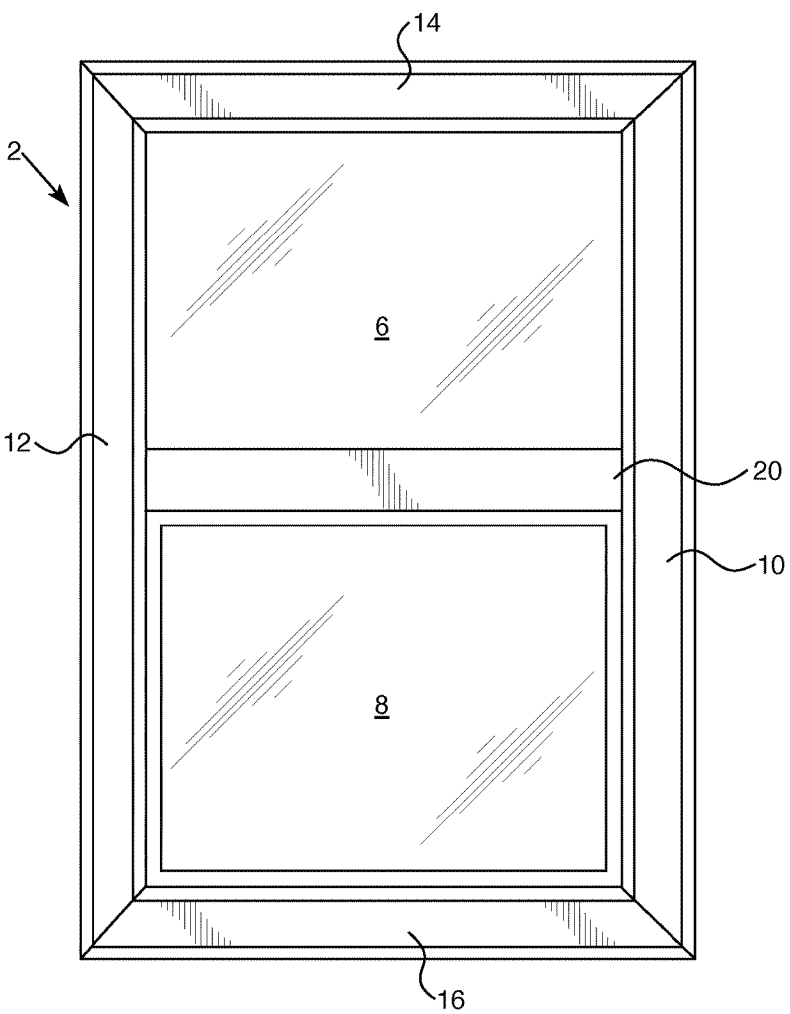
FIG. 2 is a rear elevational view of the window of FIG. 1.
Figure 1:
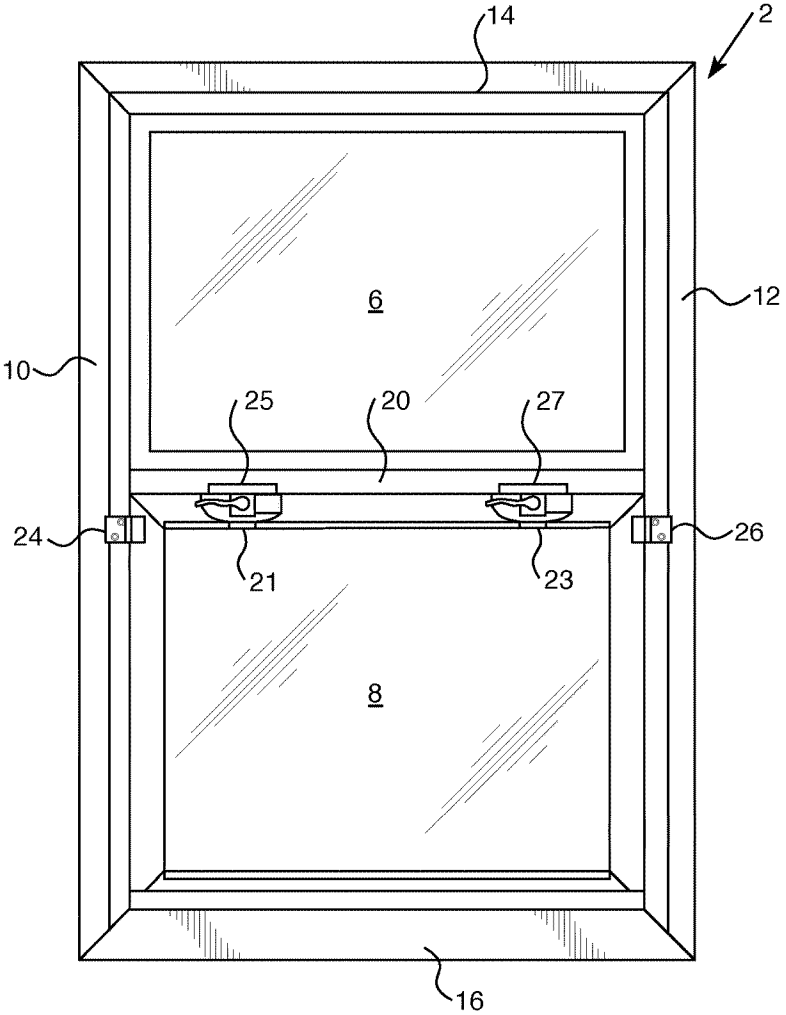
FIG. 1 illustrates an interior elevational view of a first embodiment of a single hung window of the present invention.
Figure 3:
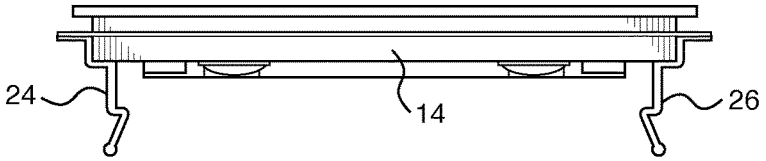
FIG. 3 is a top plan view of the window of FIG. 1.
Figure 4:
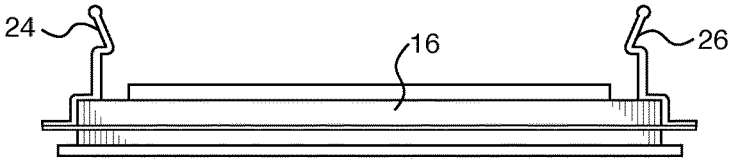
FIG. 4 is a bottom plan view of the window of FIG. 1.
Figure 5:
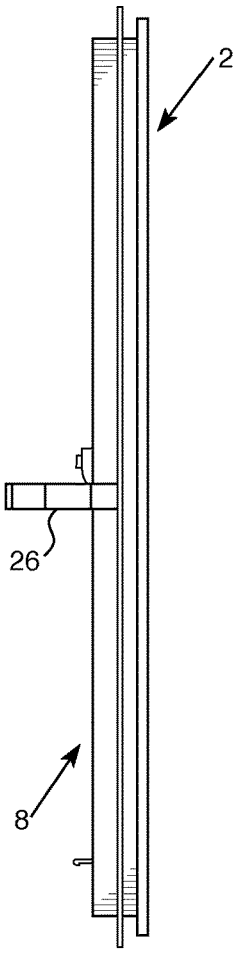
FIG. 5 is a right elevational view of the window of FIG. 1.
Figure 6:
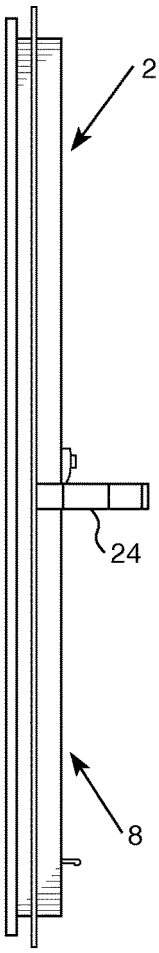
FIG. 6 is a left elevational view of the window of FIG. 1.

As employed herein the terms "inside", "interior" "interiorly" and similar words shall refer to the side of the window which faces the interior of the building in which it is installed.

As employed herein, the terms "outside", "exterior", "exteriorly" and similar words shall refer to the portion of the window which faces the outside of the building in which it is installed.

As employed herein, the term "generally coplanar" means that there is a relationship between the upper fixed lite of glass and the lower sash such that in closed position, one overlies the other, as contrasted with prior art single hung windows wherein relative to the upper fixed lite of glass, the sash is in a different plane so as to permit unobstructed linear vertical movement of the sash to a position generally adjacent to the upper fixed lite of glass.

Referring to FIGS. 1 through 6, there is shown a single hung window 2 having an upper fixed lite of glass 6 and a movable lower sash 8. The moveable lower sash 8 contains a glass lite. The upper fixed lite of glass 6 and the moveable lower sash 8 are secured within a window frame 2 which consists of side jambs 10,12, a head 14 and sill 16. A fixed meeting rail 20 is secured to side jambs 10,12. The window 2 structure is best seen in FIGS. 3 through 6. The lower sash 8 is positioned in underlying relationship with respect to the upper fixed lite of glass 6 such that they are generally coplanar. In the form shown in FIGS. 1 through 6, a pair of lower retention elements in the form of clips 24,26 are secured respectively to jambs 10 and 12 such that a first portion of each clip is secured to the jambs 24,26 and a free portion extends away from the jambs for inter-engagement with the movable lower sash 8. The clips are generally aligned with each other. The flexibility of the clips 24,26 facilitate manual movement of the same to achieve the position shown in FIGS. 7(*a*) through 7(*c*). Lock 17 and keeper 19 are shown in FIG. 7(*b*) in the open position.

Figure 7A:
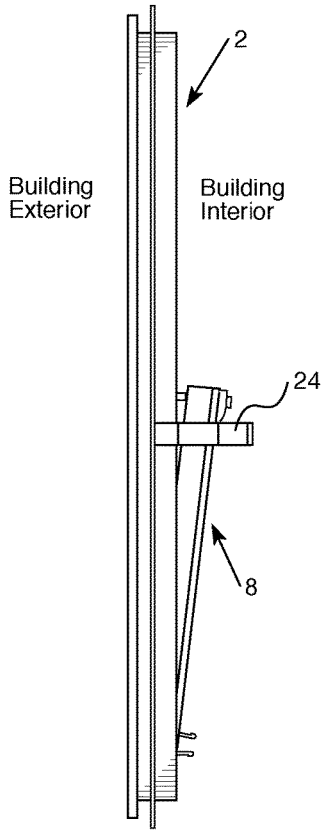
FIG. 7(*a*) is an left elevational view showing the window of FIGS. 1 through 6 with the lower sash tilted to provide a vent opening.
Figure 7C:
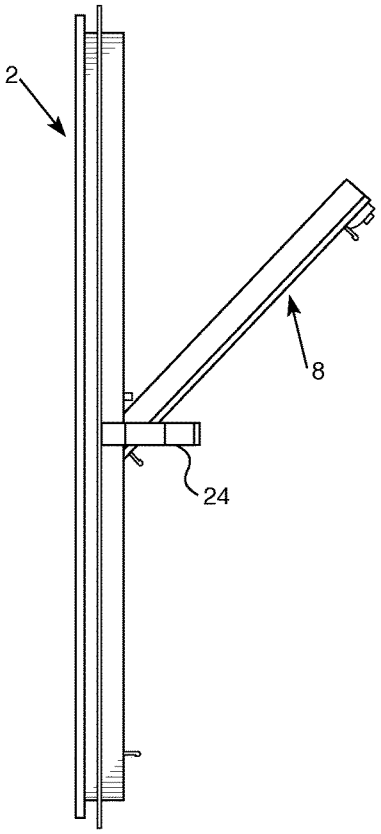
Figure 7B:
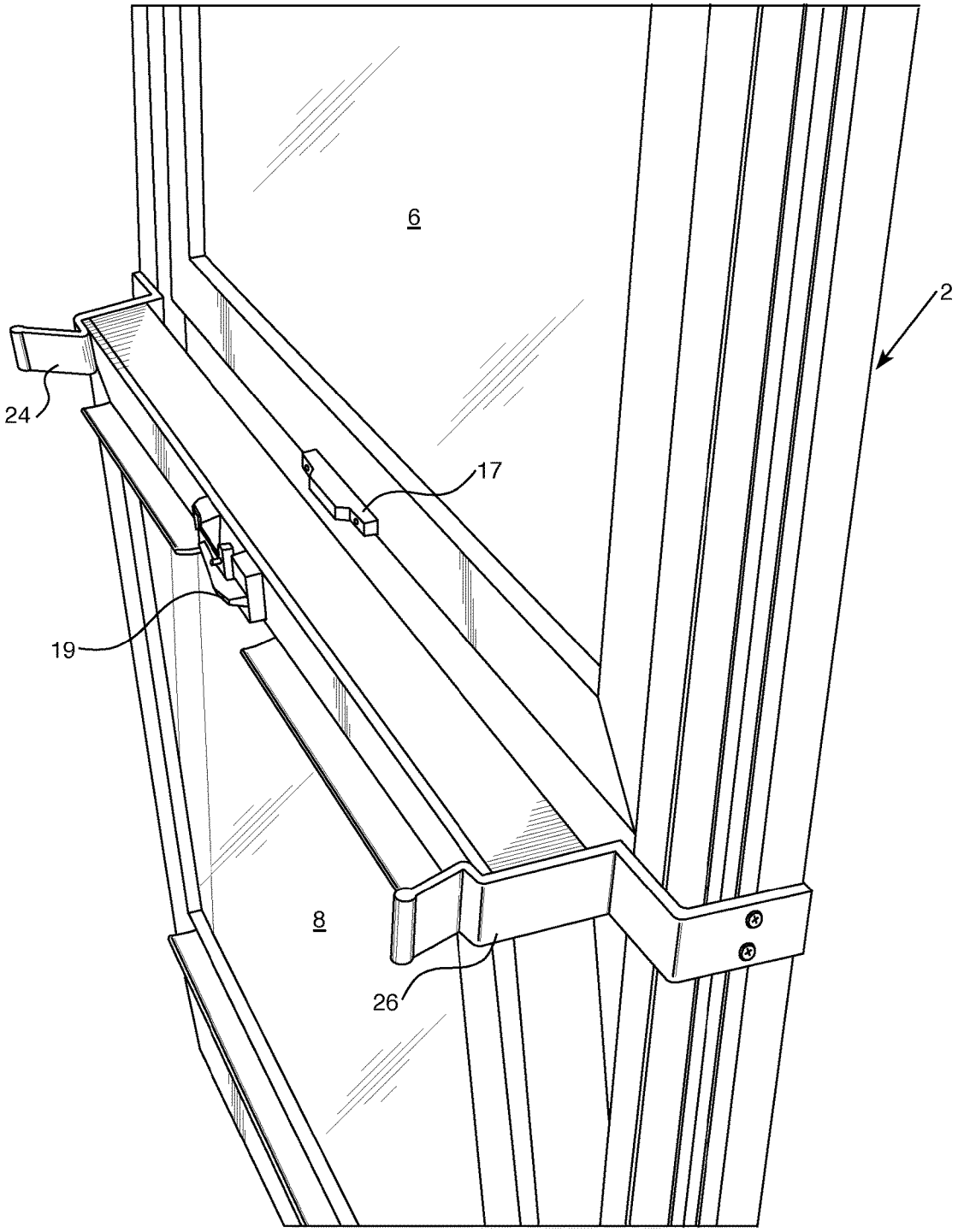
Figure 9:
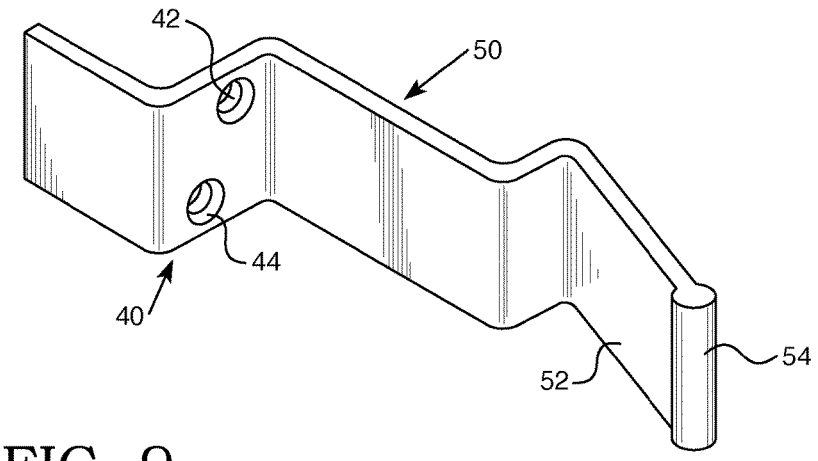
FIG. 9 is a perspective view of a clip of the present invention which is structured to be secured to the window frame and to be operatively associated with the lower sash.
Figure 10:
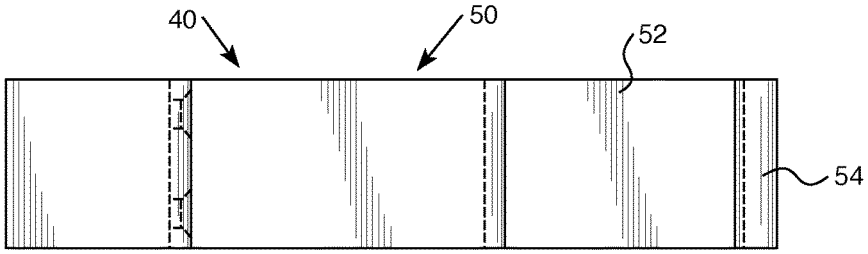
FIG. 10 is a front elevational view of the clip of FIG. 9.
Figure 12:
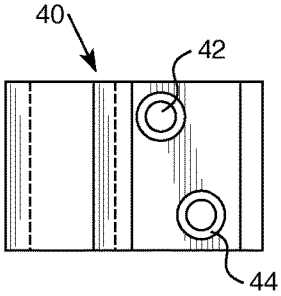
FIG. 12 is a left hand elevational view of the clip of FIG. 10.
Figure 11:
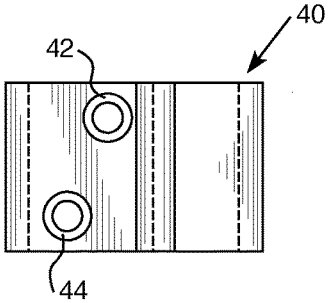
FIG. 11 is a right hand view of the clip of FIG. 10.
Figure 13:
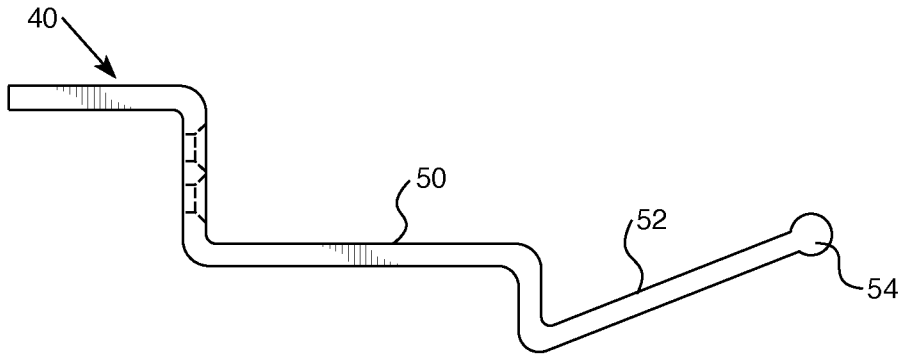
FIG. 13 is a bottom plan view of the clip of FIG. 10.
Figure 14:
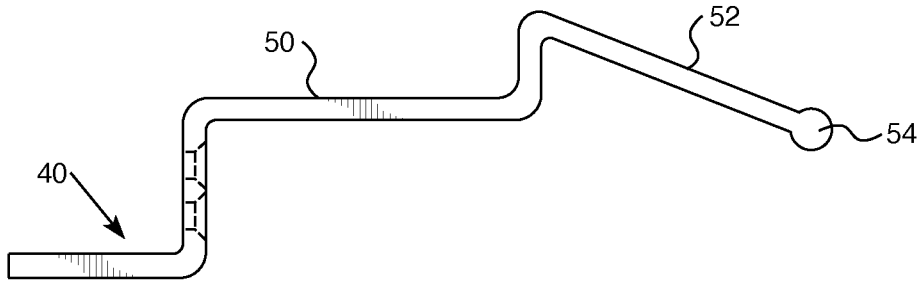
FIG. 14 is a top plan view of the clip of FIG. 10.

As shown in FIGS. 7(*a*) and 7(*b*), the lower sash 8 is tilted toward the interior of the building and is in a vent position being engaged within clips 24,26. Ready manual displacement of the clips 24,26 facilitates the sash 8 assuming the position shown in FIG. 7(*c*). FIG. 7 (*c*) shows the lower sash 8 in the fully open position As shown in FIG. 7 (*c*), the lower sash 8 is shown hinged to be rotated upwardly while having its lower portion engaged with clip 24 and thereby establishes the full open position for lower sash 8.

Figure 8:
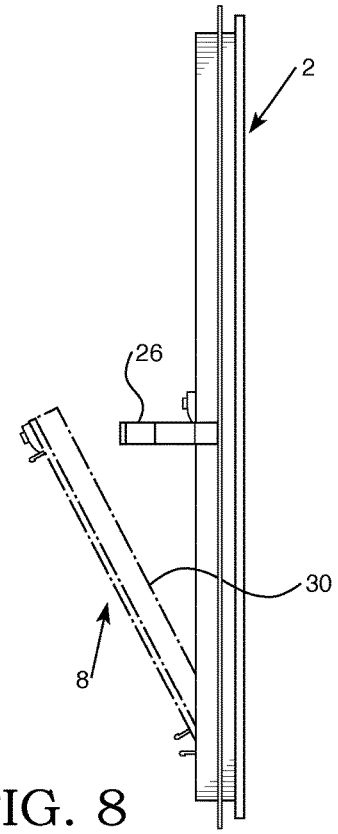
FIG. 8 is a right elevational view showing the window of FIGS. 1 through 6 rotated inwardly to permit cleaning.

FIG. 8 shows the lower sash 8 rotated in toward the interior of the building in a position where it is out of contact with clips 24, 26 and may be readily have its exterior surface 30 cleaned from the interior of the building.

Referring to FIGS. 9 through 14, details of the preferred version of the clips shown in FIGS. 1 through 8, will be considered. The clips are preferably an elongated resilient elements which may be made from a suitable metal, such as stainless steel or aluminum, for example, or a suitable resinous plastic such as vinyl, for example. A first end of the clip 40 has a pair of fastener receiving openings 42,44 through which suitable fasteners, such as screws, may pass in securing the clip to the window frame jambs. The extending free portion of the clip is designed to hold the movable lower sash 8 in one of two positions. As shown in FIGS. 7(*a*) and 7(*b*), the lower sash 8 is extending angularly toward the interior of the building and assumes a tilted vent position. In this position, it is supported by the portion of the clip designated 50 in FIGS. 9, 10 and 14.

Referring to FIG. 7 (*c*), in the vertically elevated fully open position, the lower sash 8 is engaged with portion 50 of the clip 40. Clips 40 terminates in an enlarged section 54 to facilitate the clip springing out when the lower sash 8 is closed against 52 after cleaning.

Figure 15A:
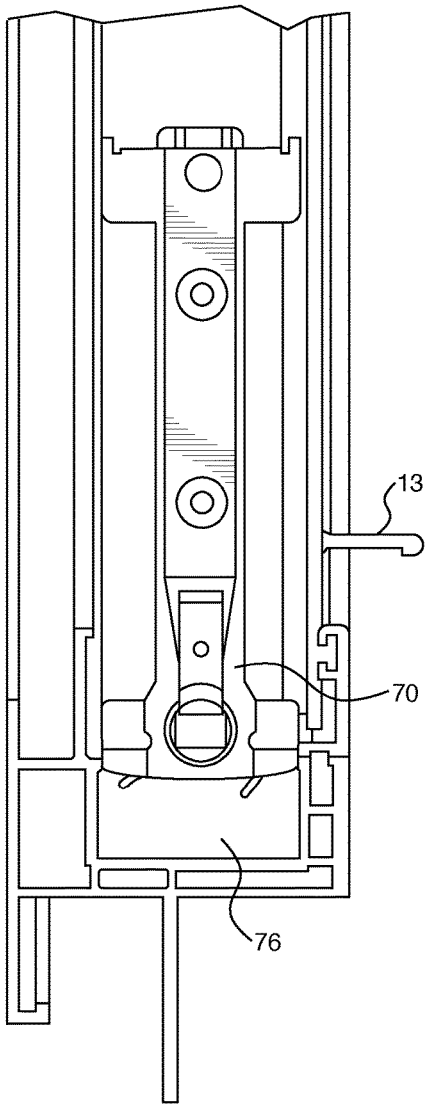
FIG. 15 (*a*) is an elevational view of a window balance system employable in the present invention.
Figure 15B:
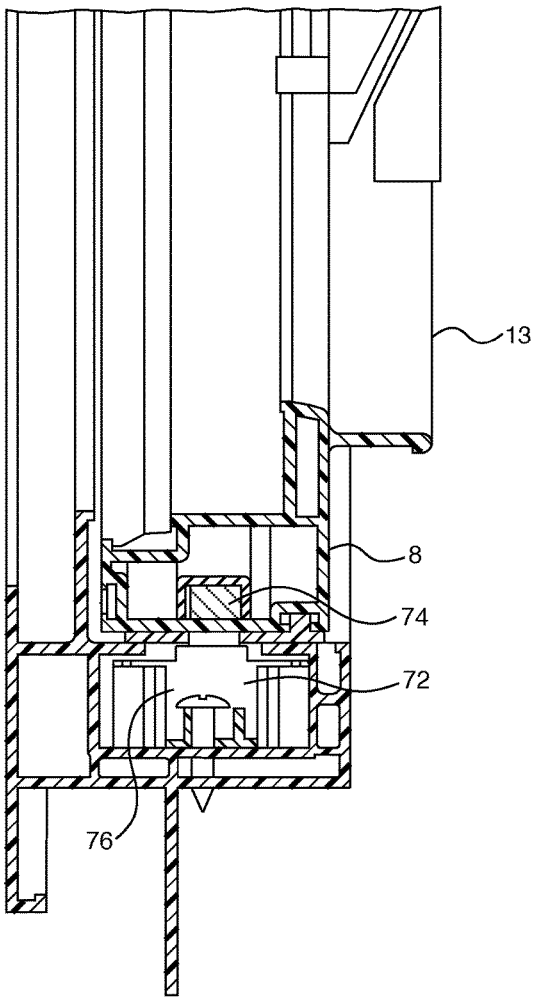
Figure 16:
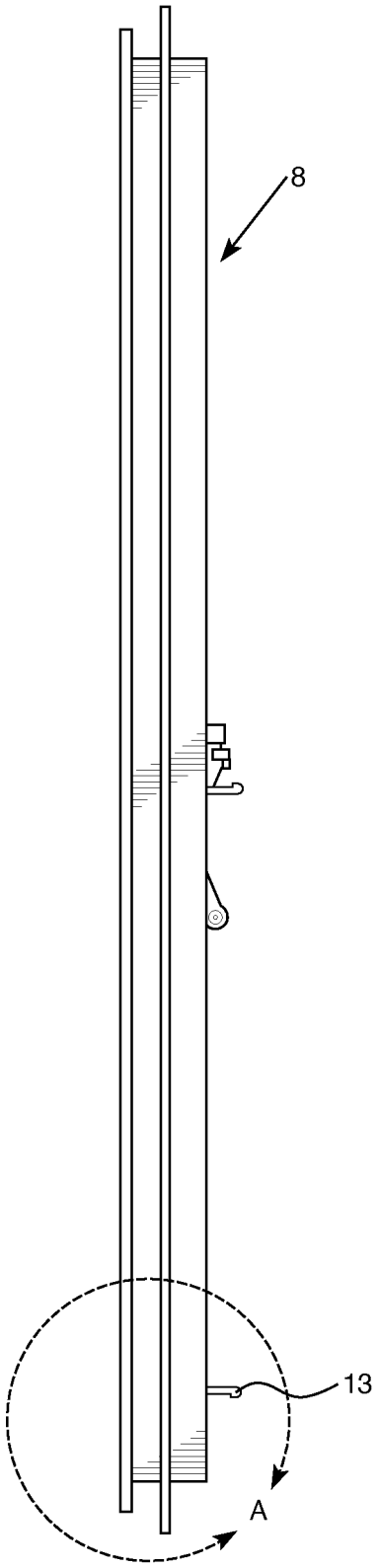
FIG. 16 is an end elevational view showing the window in which the balance system of FIGS. 15 (*a*) and 15 (*b*) may be placed.
Figure 18:
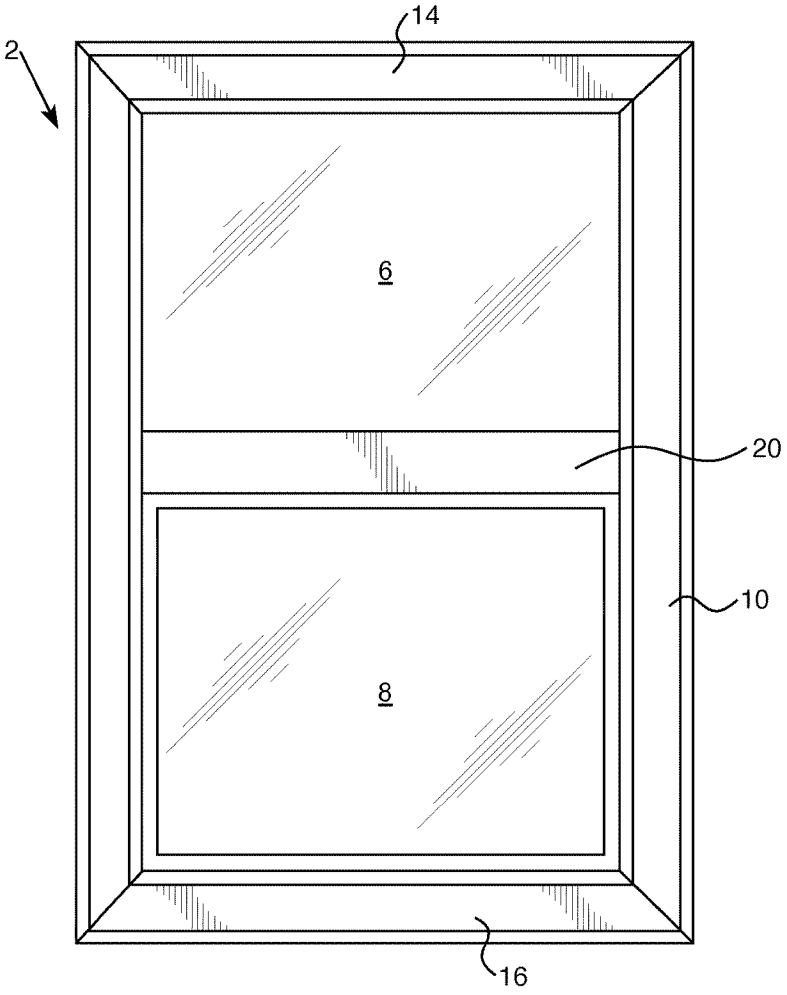
FIG. 18 is an elevational view of the window of FIG. 17 showing the exterior of the window.

As shown in FIGS. 15 (*a*), 15 (*b*), and 16, the lower sash 8 is provided with a balance system 70 within each of the window frame jambs and secured to the lower sash in the region indicated generally in FIG. 16 by the broken circle "A". Lift handle 13 is manually engageable to facilitate opening and closing the lower sash 8

FIG. 15 (*b*) which is shown in section, shows the window balance assembly 72 is operatively associated with pivot bar 74 which is operatively associated with the lower sash 8 and allows the window to pivot inwardly as the balance 72 moves within the balance pocket 76.

Referring to FIGS. 17 through 23 (*c*), there is shown a modified form of sash retention system.

Figure 23A:
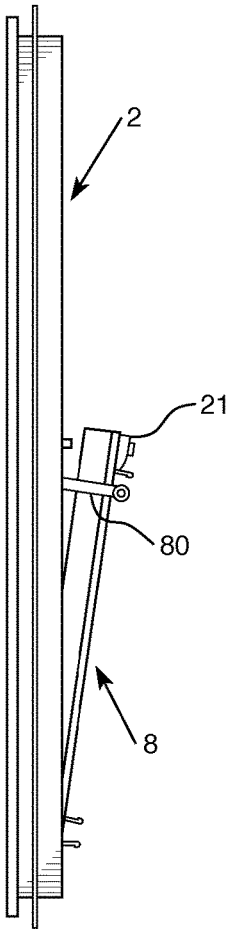
FIG. 23(*a*) is a left elevational view of the window of FIG. 17 showing the lower sash tilted to provide a vent opening.
Figure 23B:
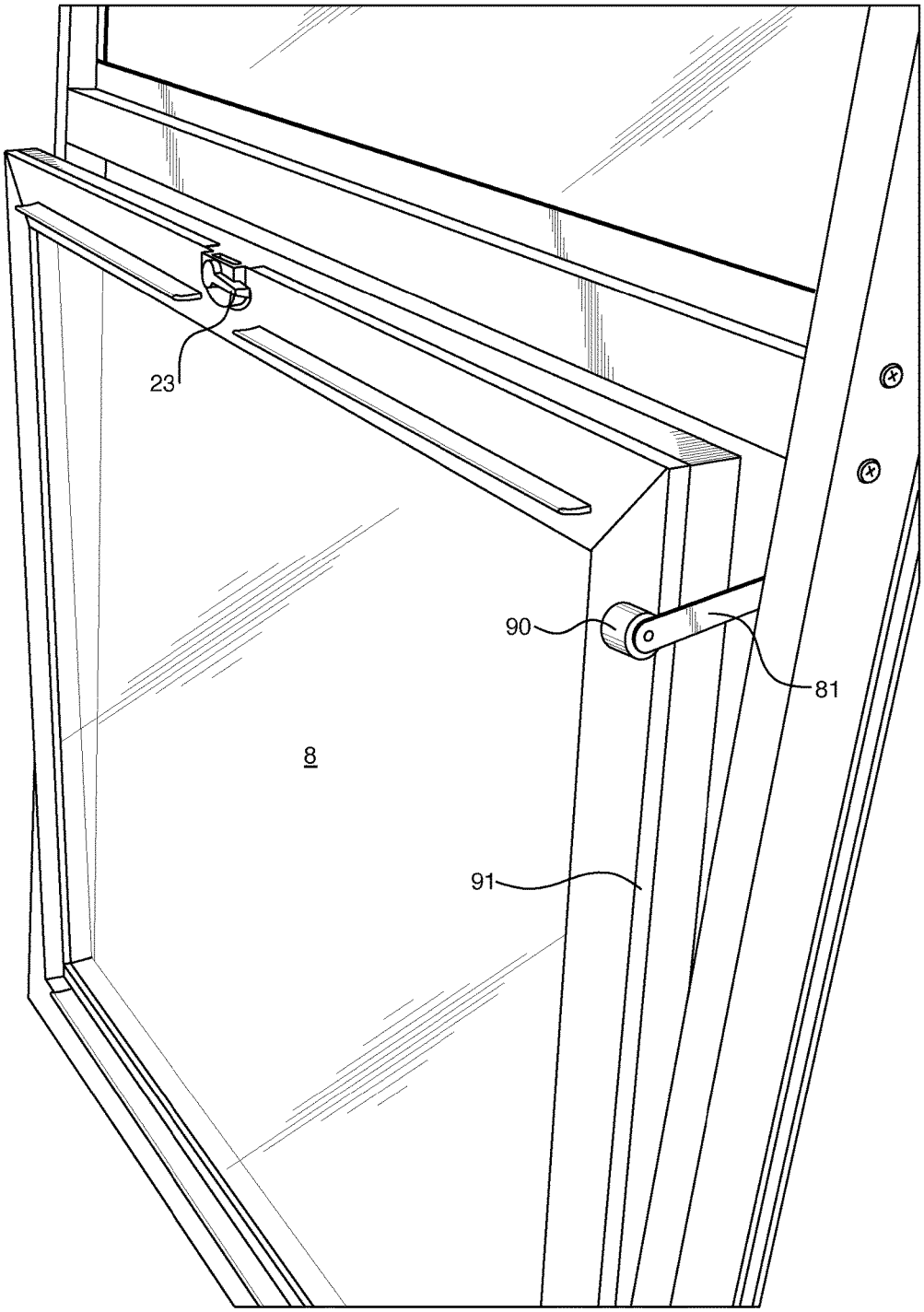
Figure 23C:
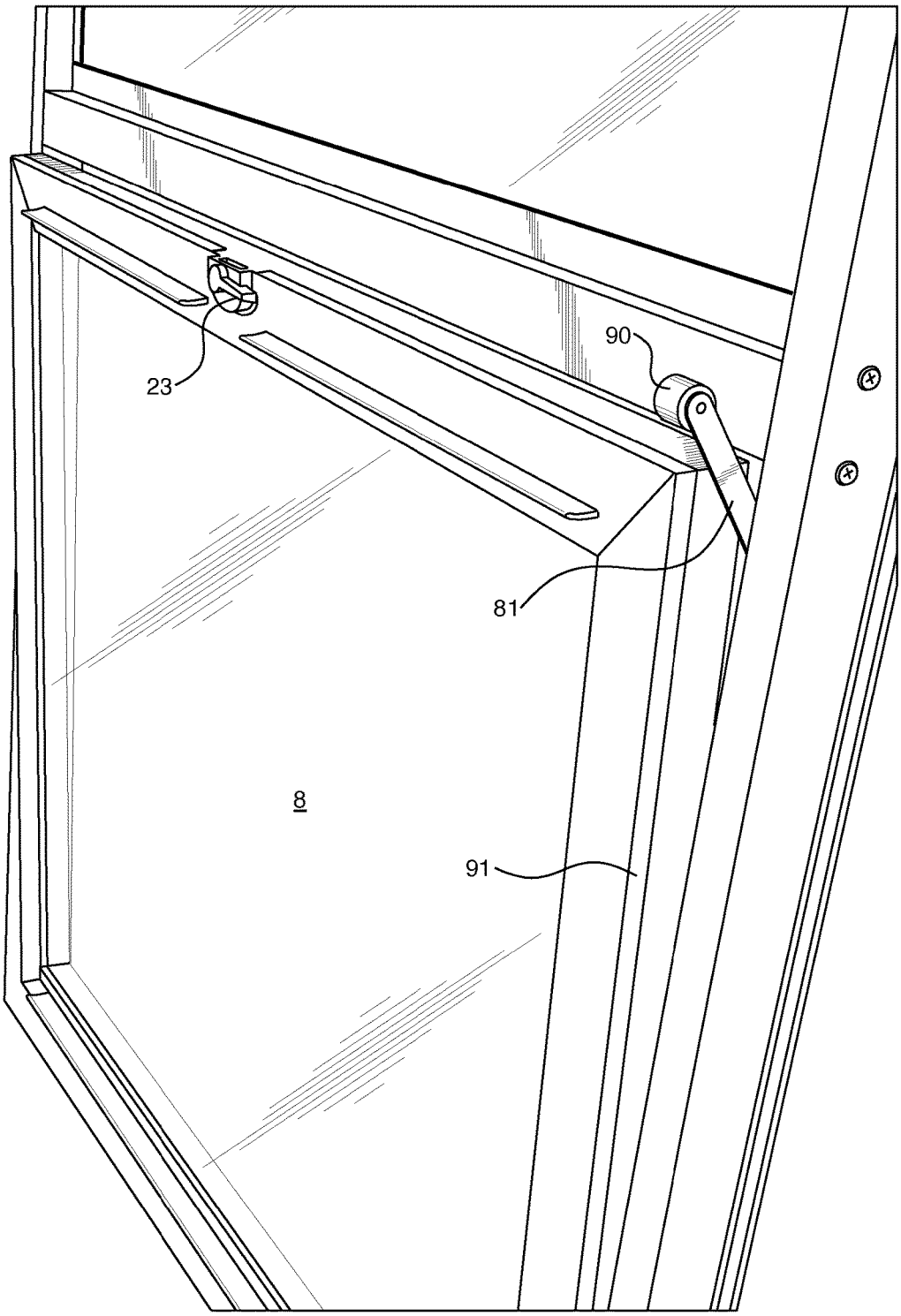

FIG. 23(*b*) shows the sash 8 in vent position with lower sash retention elements 81 and 82 (only 81 shown in this view) in engagement with the sash portion 91 through roller 90, thereby resisting further movement of sash 8 into the building interior.

FIG. 23(*c*) is a perspective view of the window of the sash 8 rotated farther inwardly than the vent position with sash retaining means 81 having been manually moved so that roller 90 is out of engagement with sash portion 91. This view shows the sash retention element 81 having been manually moved such that the roller 90 is no longer in an engagement with sash extension portion 91 thereby permitting the further rotational movement of the sash 8 toward the building interior for cleaning. The sash retention element 81 may, in this manner, be manually moved into and out of position to retain the sash in the desired location. The same is true with respect to sash retention element 80 (not shown in this view).

Figure 17:
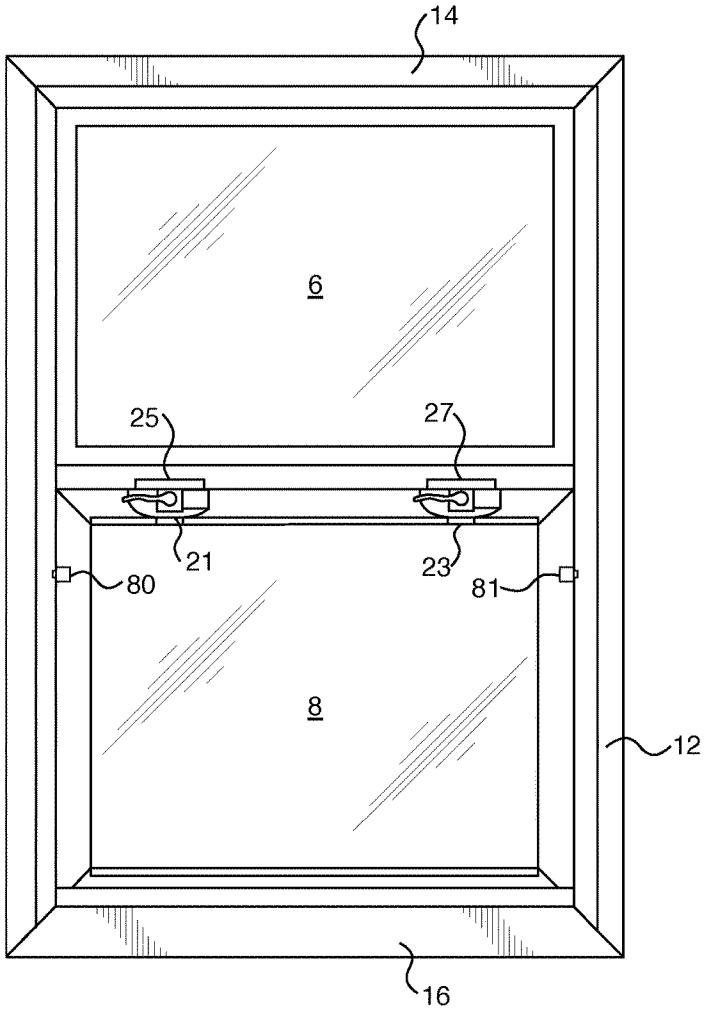
FIG. 17 is an interior elevational view of a second embodiment of the window of the present invention.
Figure 19:
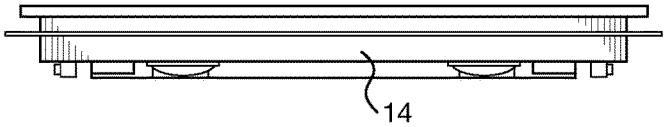
FIG. 19 is a top plan view of the window of FIG. 17.
Figure 20:
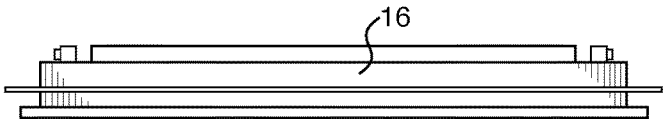
FIG. 20 is a bottom plan view of the window of FIG. 17.
Figure 21:
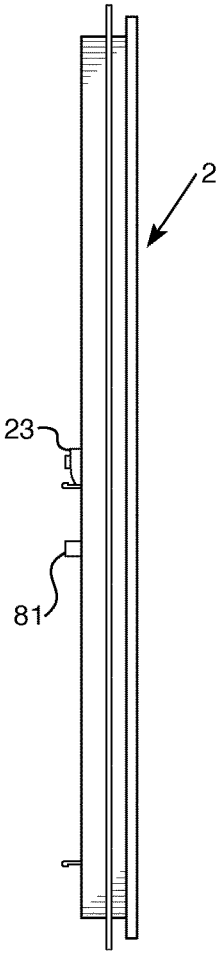
FIG. 21 is a right side elevational view of the window of FIG. 17.
Figure 22:
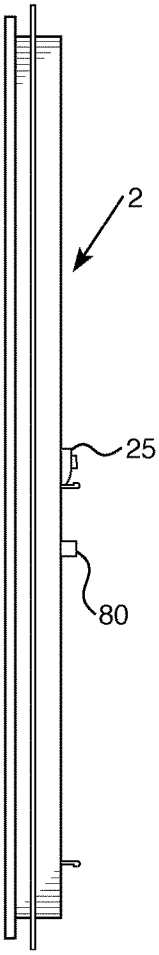
FIG. 22 is a left side elevational view of the window of FIG. 17.

In this embodiment of the invention, as shown in FIG. 17, the lower sash 8 has a pair of lock members 21,23 mounted to the upper rail thereof with a cooperating pair of keepers 25,27 operatively associated, respectively, with the locks 21,23 to permit one to lock and unlock the lower sash 8 in closed position from the interior of the building. In the form shown, the lock 21,23 is operated by rotating the gripped portion to effect a locked or unlocked position.

Referring to FIGS. 17 through 26, a modified form of movable lower sash 8 securement will be considered. FIG. 23(*a*) shows the lower sash 8 in tilted vent position secured by lower sash retention elements 80,81 (only 80 shown).

Figure 24:
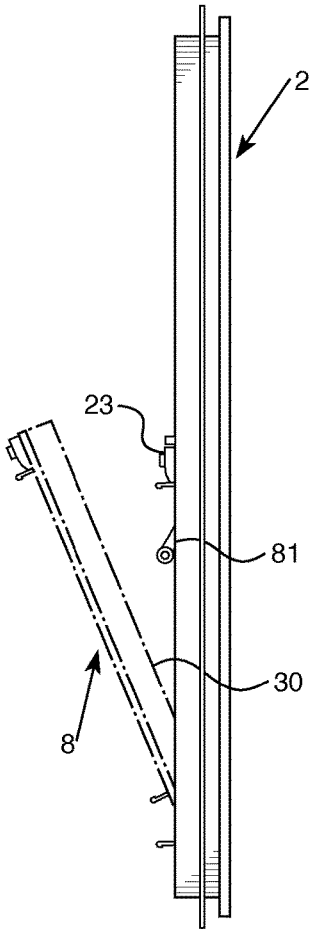
FIG. 24 is an elevational view of the window of FIG. 17 showing the sash moved to a cleaning position which permits the external surface may be cleaned from the inside of the building.

Referring to FIG. 24, the sash has been rotated toward the interior of the building so as to permit the exterior facing surface 30 of the sash to be cleaned from the interior of the building.

Figure 25A:
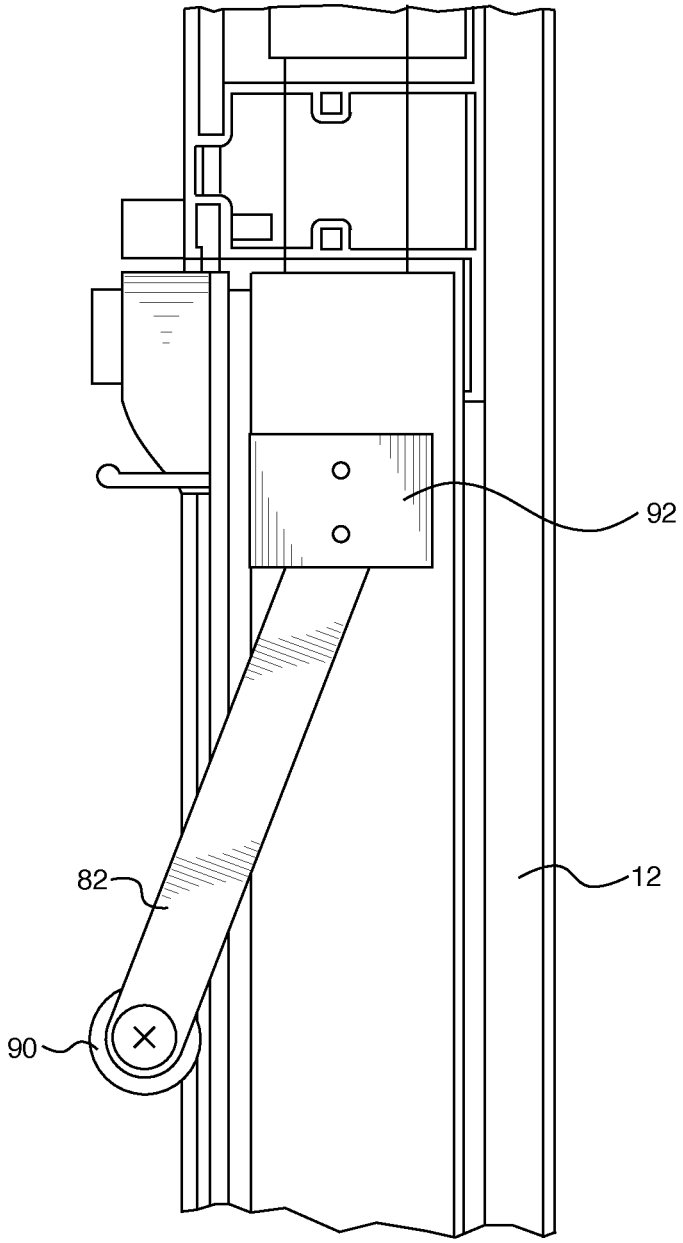
FIGS. 25 (*a*) and 25 (*b*) show respectively an illustration of the sash retaining system and lock and keeper with the jamb not shown for clarity of illustration and lower across-sectional view taken from the opposite side.
Figure 25B:
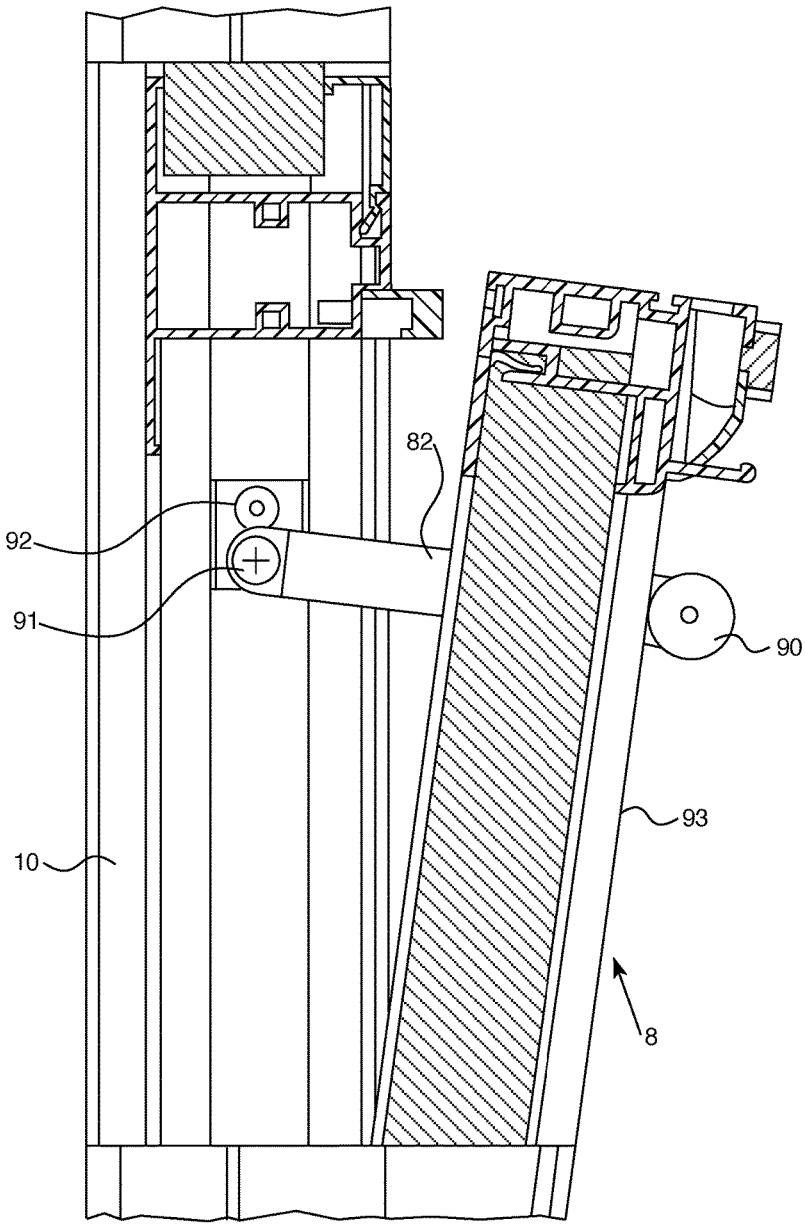
Figure 25C:
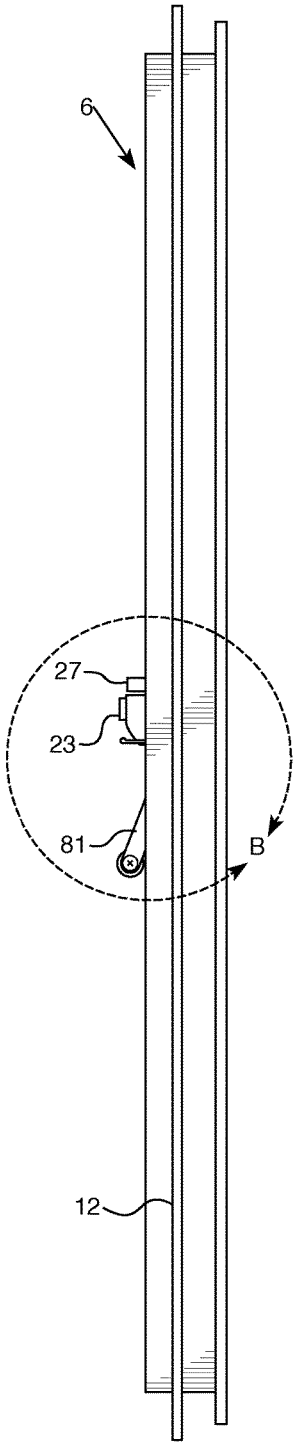
Figure 26A:
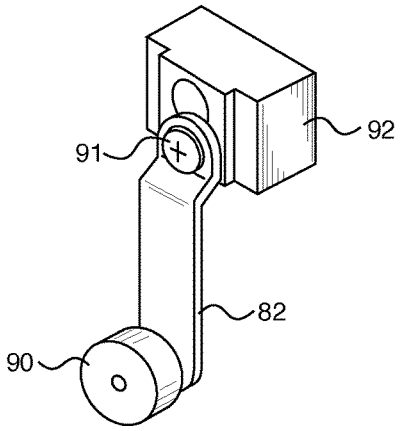
FIG. 26 (*a*) is an isometric view of the retention assembly of FIGS. 25 (*b*) and 25 (*c*).
Figure 26B:
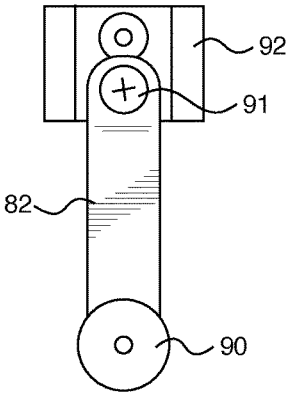
Figure 26C:
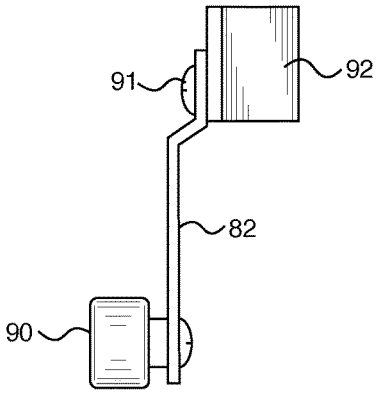
Figure 26D:
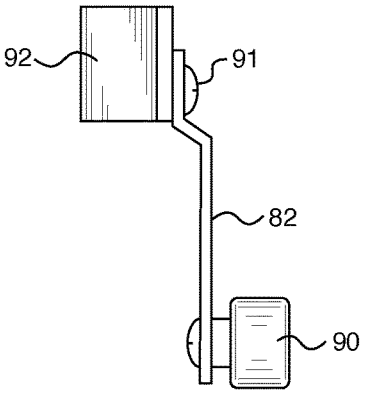
Figure 26E:
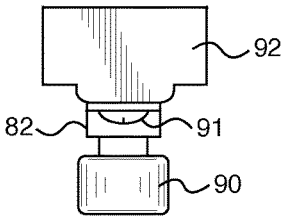
Figure 26F:
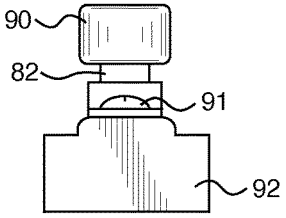
Figure 28:
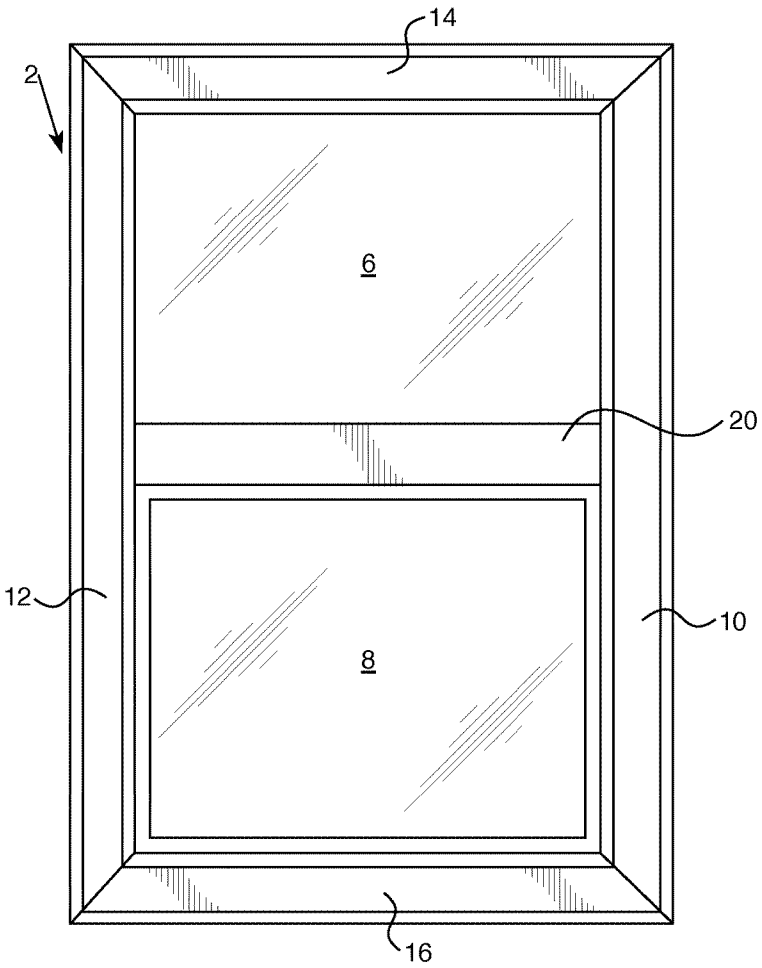
FIG. 28 is a rear elevational view of the window of FIG. 27.
Figure 27:
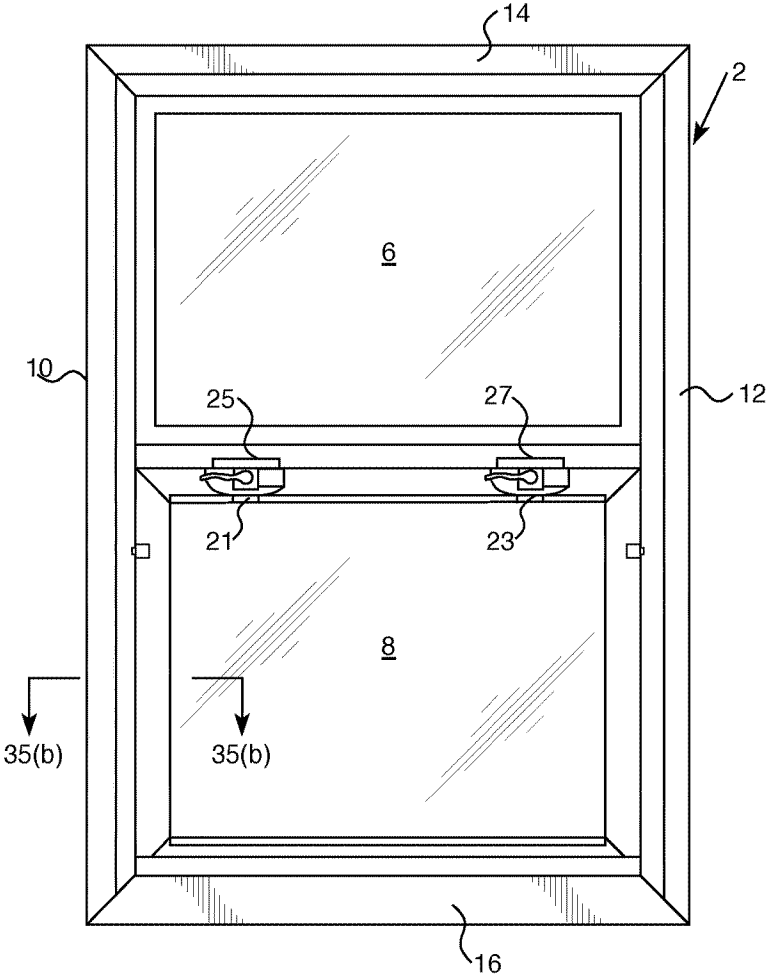
FIG. 27 shows an interior elevational view of a third embodiment of a single hung window of the present invention.
Figure 29:
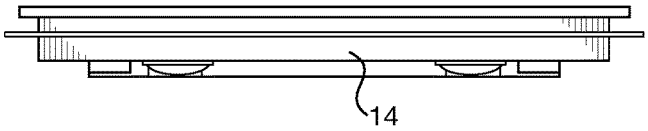
FIG. 29 is a top plan view of the window of FIG. 27.
Figure 30:
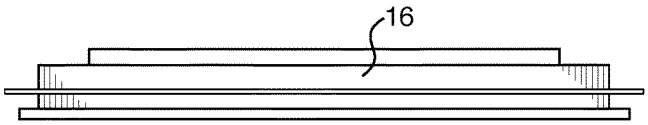
FIG. 30 is a bottom plan view of the window of FIG. 27.
Figure 31:
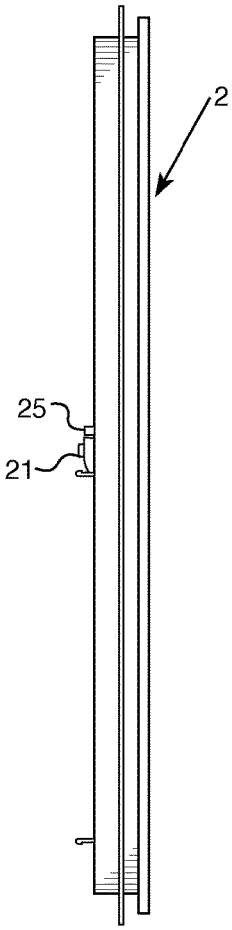
FIG. 31 shows the right side elevation of the window of FIG. 27.
Figure 32:
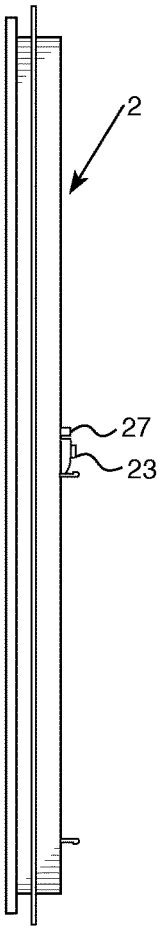
FIG. 32 shows the left side elevation of the window of FIG. 27.
Figure 33:
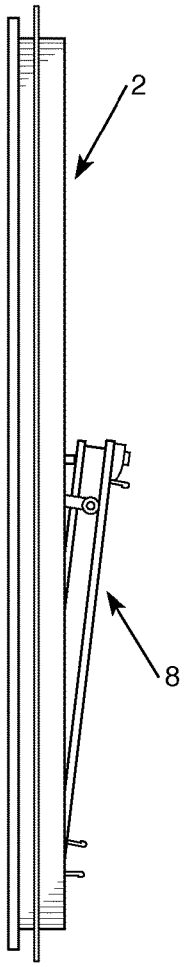
FIG. 33 is a left side elevational view of the window of FIG. 27 showing the tilted vent opening position.
Figure 34:
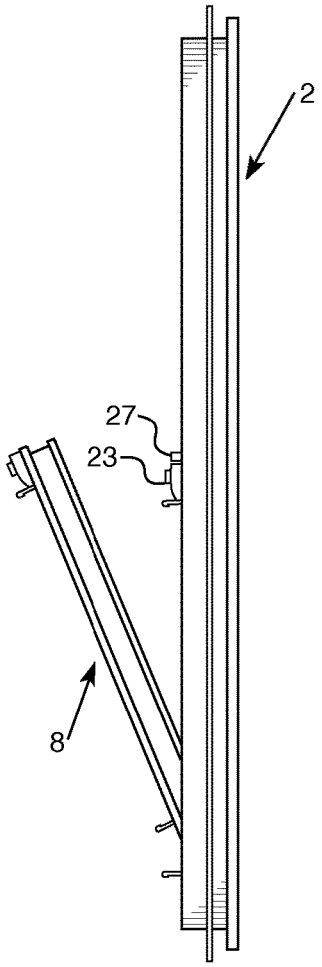
FIG. 34 is an elevational view showing the lower sash rotated interiorly to facilitate cleaning of the exterior surface thereof from the interior of the building.

Referring to FIGS. 17 through 26, in this embodiment, a pair of sash engagement elements 80,81 which are employed in lieu of clips 24,26 are secured to adjacent jamb members 10,12 respectively. As shown in FIG. 25 (*c*), a sash retaining element 81 is secured to jamb 12 with a partially broken away detailed view of the portion shown within circle "B" being shown in FIGS. 25 (*a*) and 25 (*b*). The sash has connecting arm 82. A sash retaining roller 90 is secured to connecting arm 82 which rotates about fixed block 92. With reference to FIG. 25 (*b*), the connecting arm 82 pivots about fastener 91.

Referring to FIGS. 26 (*a*) through 26 (*f*), additional details of a preferred form of FIG. 25 (*b*) the retention assembly will be considered. The rotating sash engaging element 90 is preferably generally cylindrical and is structured to engage the sash element. It may be made of any suitable material, but, preferably, is made from a synthetic resinous plastic or rubber. It is mounted for axial rotation so as to facilitate efficient interengagement and relative movement with the lower sash. The connecting arm 82 is substantially rigid and may be composed of a resinous plastic or metal. The connecting arm 82 is rotatable to facilitate securing the sash 8 in a particular position and to rotate upwardly out of contact with the sash so as permit the sash to rotate toward the interior of the building for cleaning.

With reference to FIGS. 26 (*a*) through 26 (*f*) and FIG. 23 (*a*), there is shown sash 8 tilted to a vent opening position with a pair of lower sash retaining elements 80,81 each having a sash roller 90 in contact with an outer surface 93 of sash 8. The connecting arm 82 is pivoted about fastener 91 which is secured to block 92 which is in a fixed position. The balance travel and sash angle in full open position dictate travel.

FIGS. 27 through 36 illustrate another embodiment of the invention. For simplicity of disclosure, the FIGS. 27 through 34 will correspond generally with FIGS. 20 through 24 with common reference numbers being retained. As the lower sash retention assembly 91 (FIG. 35) is shown in its retracted position within window frame jamb 12, it does not appear in FIGS. 27 and 34.

Figure 35A:
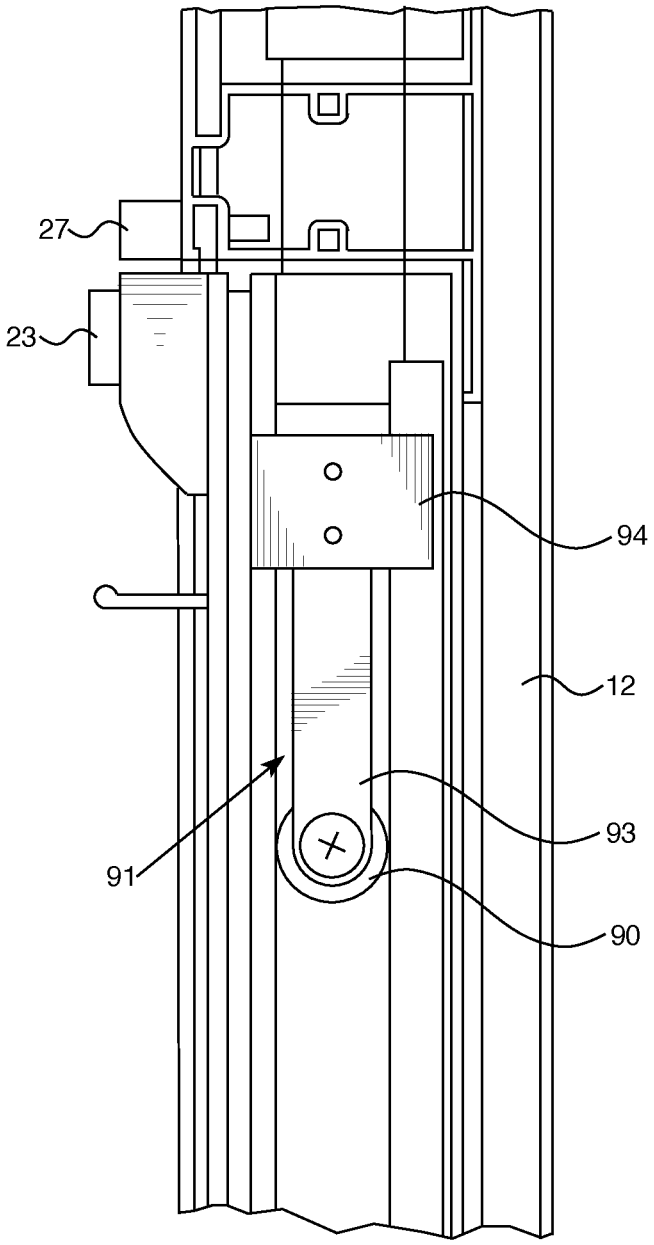
FIG. 35 (*a*) shows another form of sash retention assembly and lock and keeper.
Figure 35B:
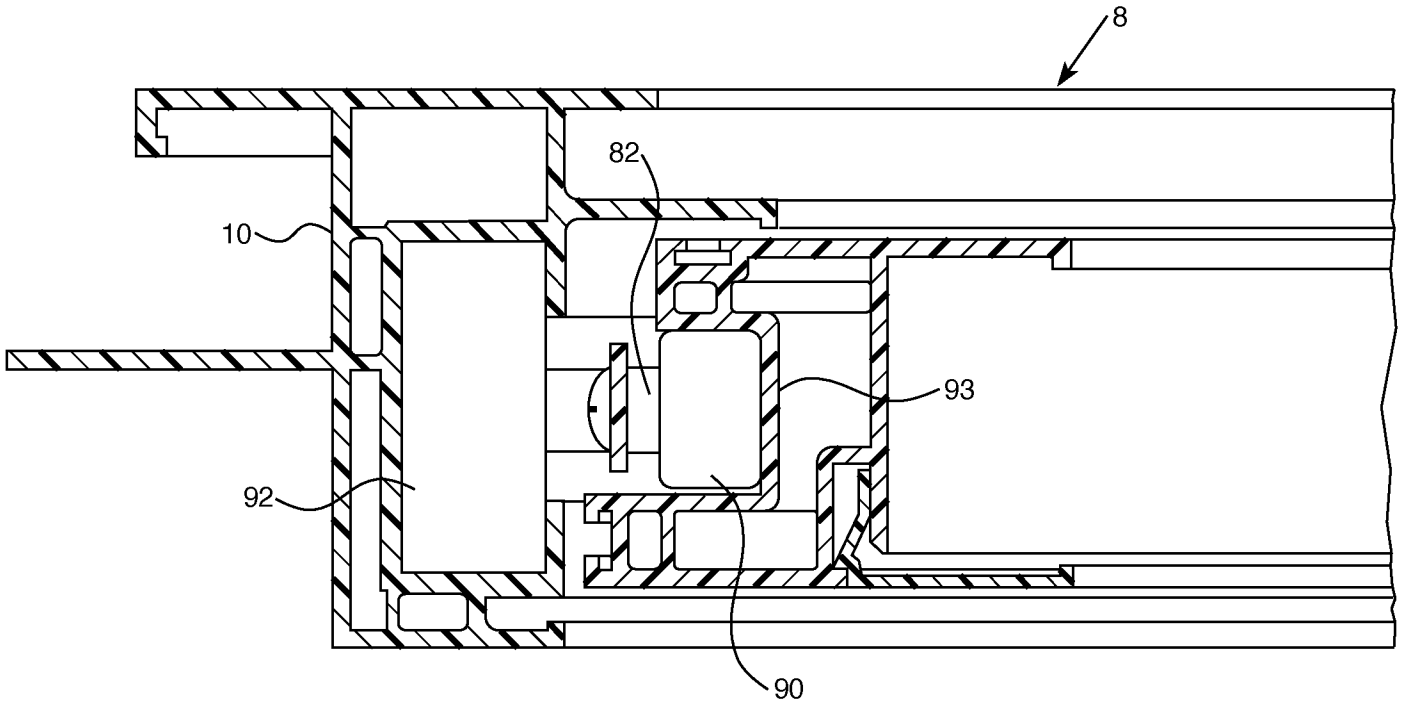
Figure 36:
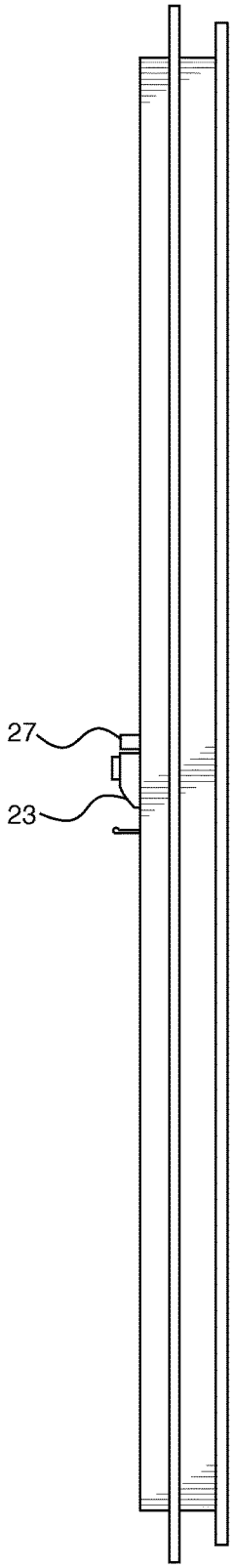
FIG. 36 is an elevational view of the sash of FIG. 35 (*a*).
Figure 38:
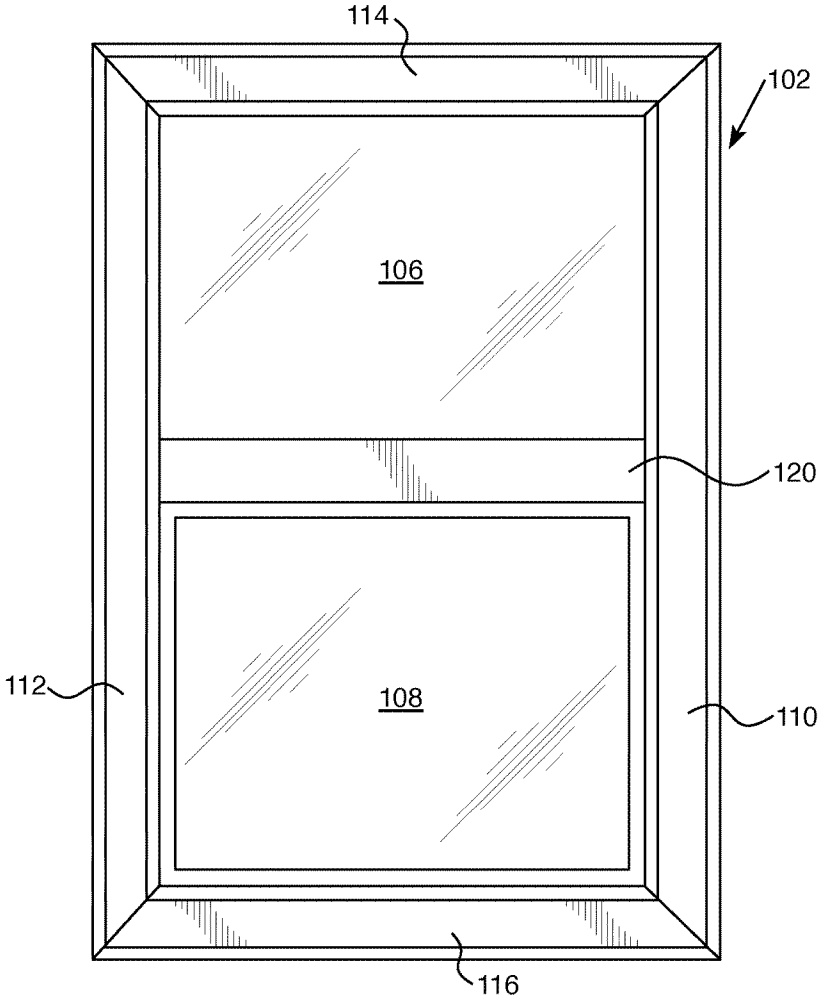
FIG. 38 is an exterior elevational view of the window of FIG. 37.
Figure 37:
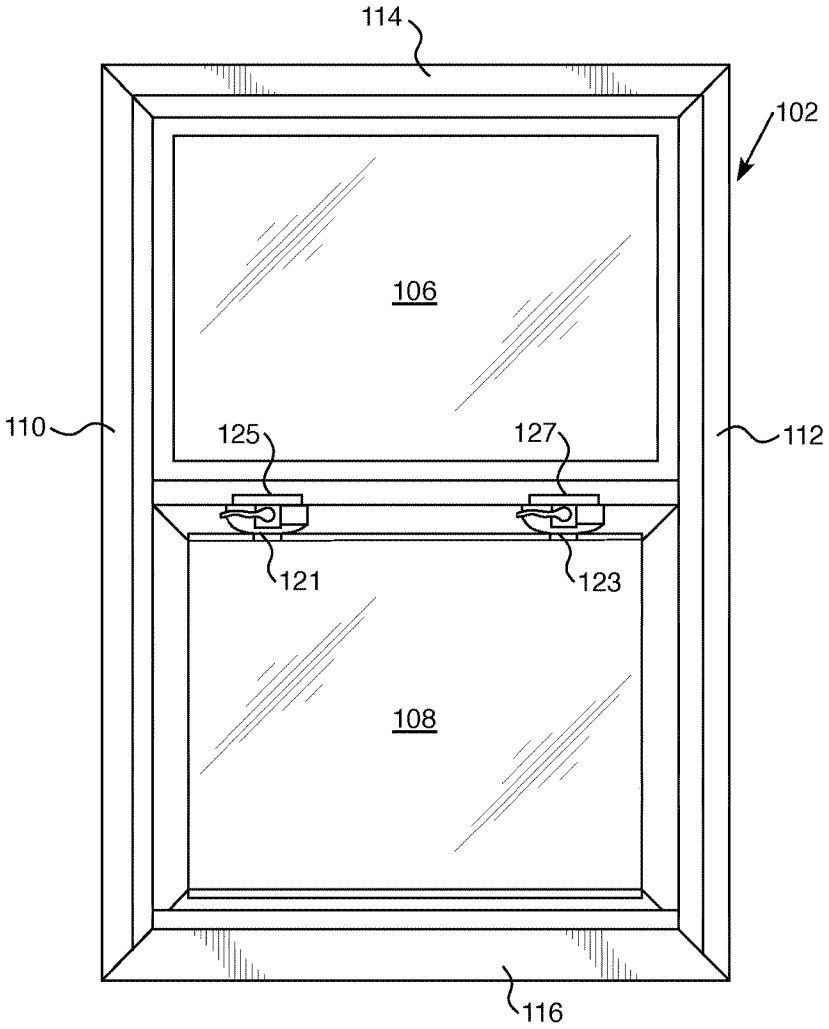
FIG. 37 is an interior elevational view of a fourth embodiment of a single hung window of the present invention.
Figure 39:
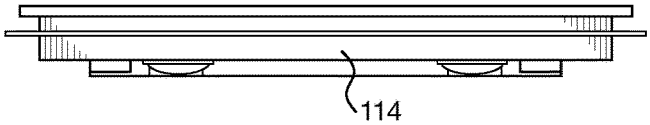
FIG. 39 is a top plan view of the window of FIG. 37.
Figure 40:
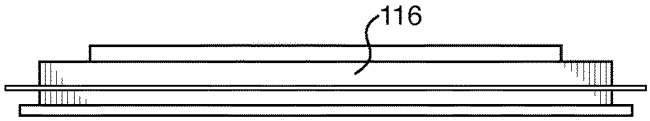
FIG. 40 is a bottom plan view of the window of FIG. 37.

Referring to FIGS. 35 (*a*), 35 (*b*) and 36 which show a section through jamb 10 and lower sash 8 along with the sash retention system. The sash retention system has block 94 which may be of the type illustrated and disclosed in connection with FIGS. 26(*a*) through 26 (*f*). Block 94 is secured through connecting arm 93 to sash roller 90 and fits within the recess in channel shaped element 93 of the lower jamb 12.

The lower sash retention element 91 includes a lower sash contacting roller 90 which is secured to a connecting arm 93 which in turn is rotatably secured to an anchor block 94. This facilitates outward rotation of portion 90,93 for engagement with the lower sash. Lower sash contacting roller 90 may be made of a suitable resinous plastic material.

Referring to FIGS. 37 through 49, a further embodiment of the invention will be considered. The single hung window has a window frame 102. Common elements in FIGS. 37 through 44 are provided with reference number which add 100 to the original number in earlier figures for convenience of establishing the relationship.

Figure 41:
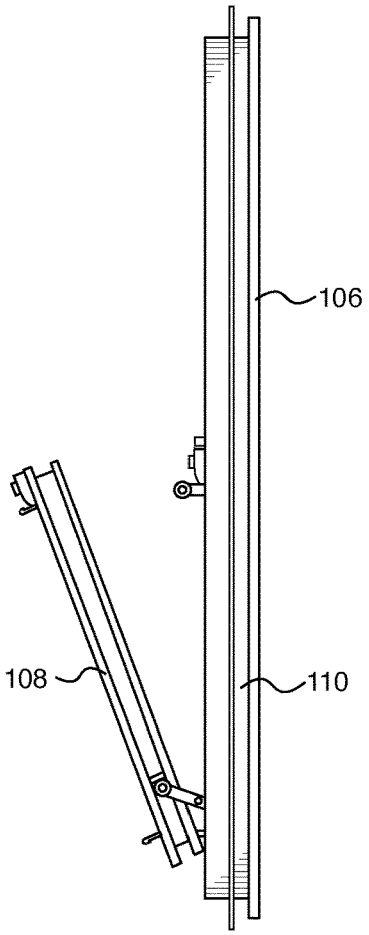
FIG. 41 is a right side elevation of the single hung window of FIG. 37 in a cleaning position.

FIG. 41 shows the lower sash 108 rotated inwardly to the cleaning position.

Figure 42:
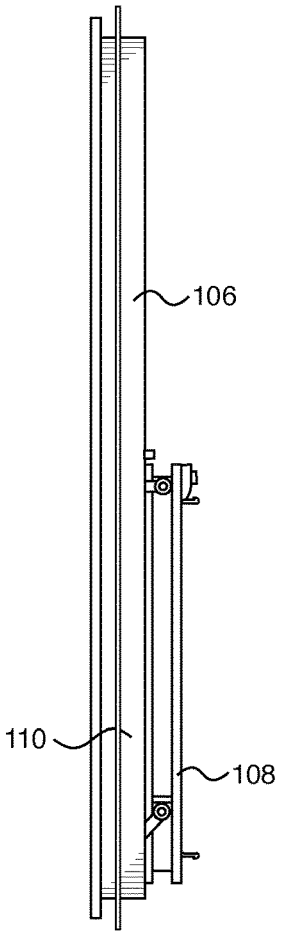
FIG. 42 is a left side elevation of the single hung window of FIG. 37 in an open position.

FIG. 42 shows the window with the lower sash 108 in the open position.

Figure 43:
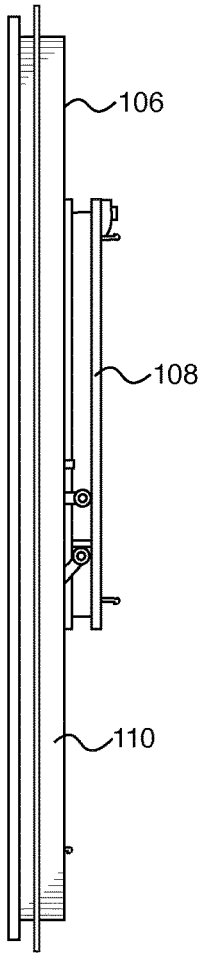
FIG. 43 is a left hand view of the window of FIG. 37 in full open position.

FIG. 43 shows the lower sash 108 having moved up to the fully open position through translational movement in a vertical direction.

Figure 44:
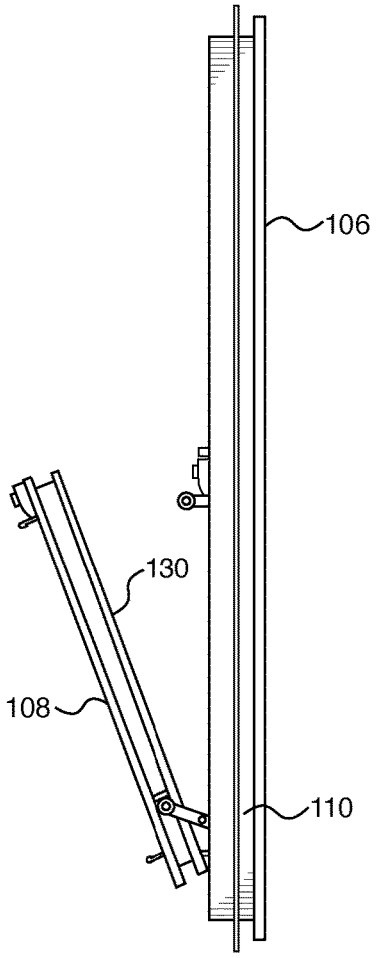
FIG. 44 is a right hand elevational view showing the cleaning position of the lower sash which permits cleaning of the exterior lite surface from the interior of the building.

FIG. 44 shows lower sash 108 tilted for cleaning of surface 130.

In FIGS. 45 through 49, the sash 108 is shown in a number of different positions.

In FIGS. 45 through 49, a lower sash retaining element 140 is rotatably mounted about pivot 142 and has a sash engaging end 144.

Figure 45:
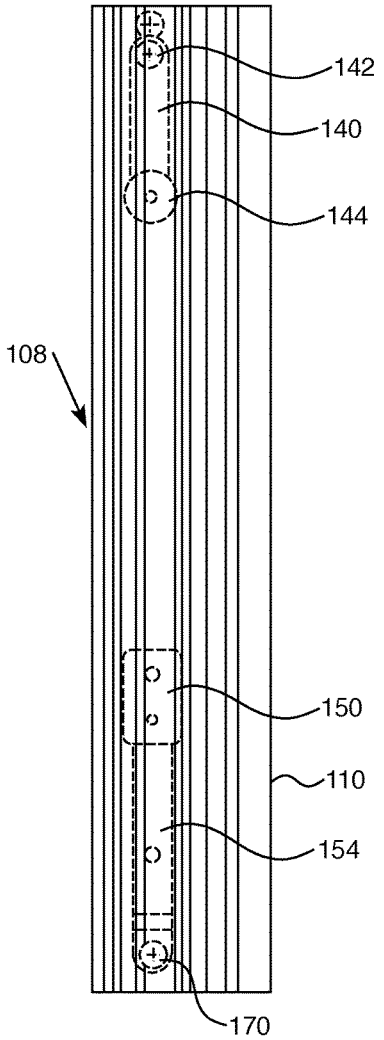
FIG. 45 is a partially broken away view of the window in the closed position.
Figure 46:
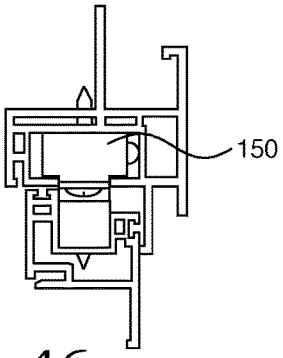
FIG. 46 is an end view of the partially broken away view of the window of FIG. 45.

FIGS. 45 and 46 show the lower sash 108 in the closed position. FIG. 45 shows the assembly in closed position. The lower sash retaining element 140 is oriented generally parallel to the window frame jamb 110 with the lower sash retention element 140 being disposed below the pivot element 142. Similarly, the link 150, link 154 and pivot 170 are also located within window frame jamb 110.

Figure 47:
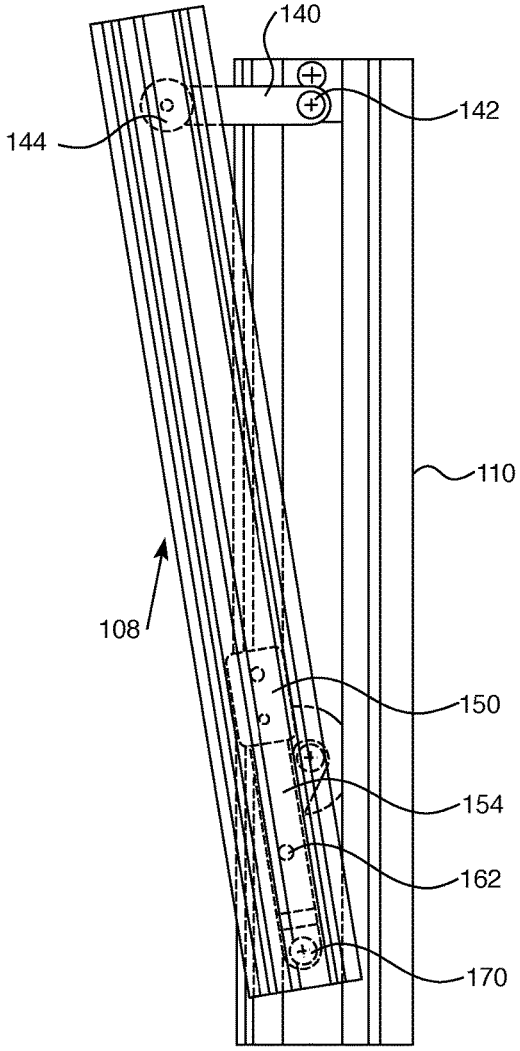
FIG. 47 shows the lower sash in the tilted vent position.

In FIG. 47, the lower sash 108 is shown in the tilted vent position. In this position, the lower sash retaining element 140 has been rotated outwardly rotating about pivot 142 with the lower sash retention element 144 being in engagement with the sash 108. Corresponding outward rotation of links 150,154 about pivot 170 is shown.

Figure 48:
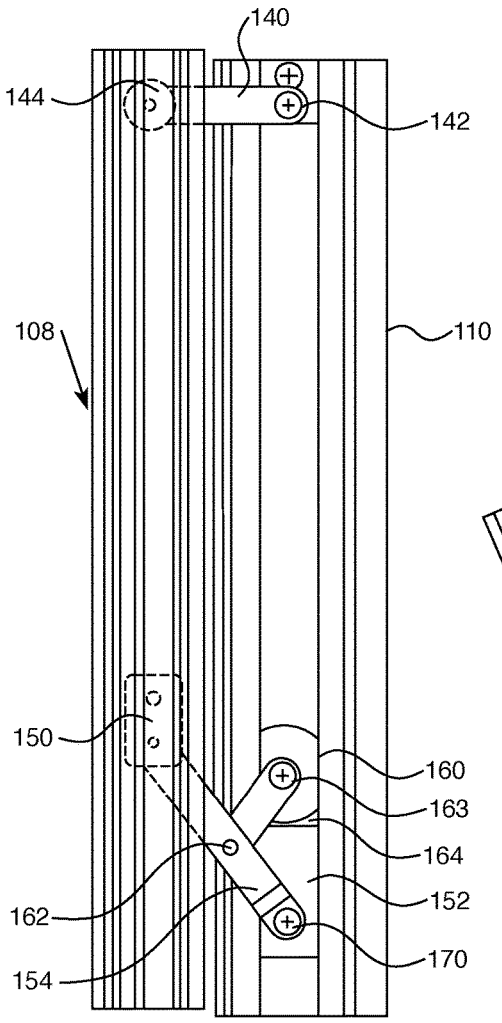
FIG. 48 shows the lower sash in an open position which is generally parallel to the frame orientation.

Referring to FIG. 48, in this embodiment, the lower sash 108 is in the open position (similar to FIG. 42) and is in generally parallel to the window jamb 110 with the lower sash retention assembly 140,142,144 having generally the same orientation as in FIG. 47. The lower portion of FIG. 48 shows the links 150,154 which have rotated about pivot 170. It also shows link 164 which is rotatable about pivot 162 of link 154 and pivot 163. The adjacent balance shoes 152 and 160 are shown.

Figure 49:
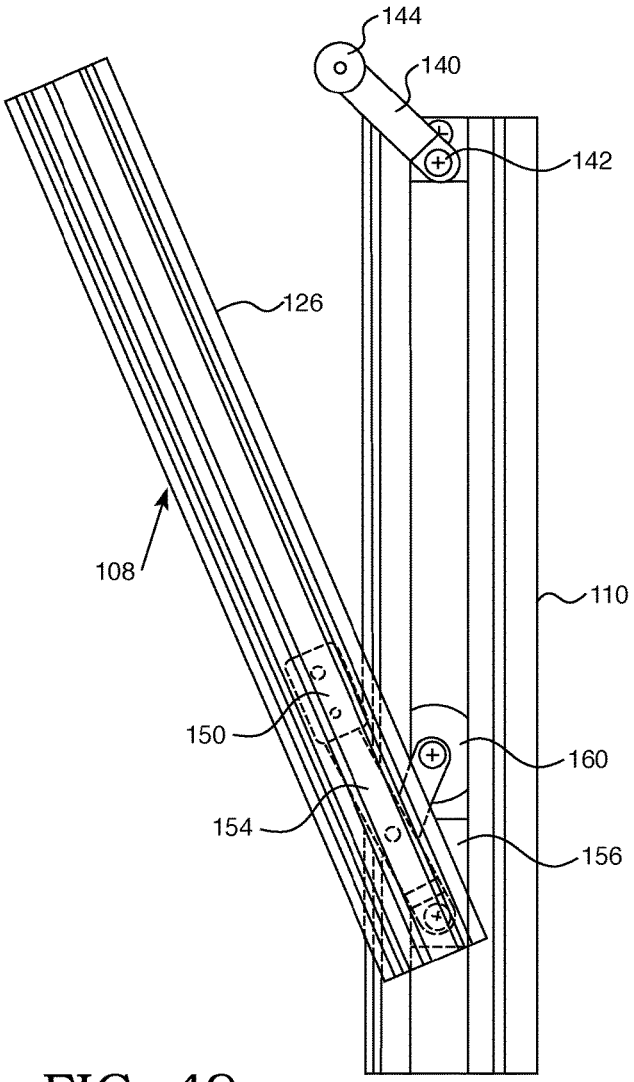
FIG. 49 shows the lower sash in the position tilted for cleaning of the exterior surface of the lower sash lite from the interior of the building.

FIG. 49 shows sash 108 tilted so that exterior sash surface 126 which normally faces the exterior of the building can be cleaned from the interior of the building. In this position, link 150 and link 154 are positioned in a generally linear relationship with the spacing between constant force balance shoe 152 and shoe 160 being increased. Retention element 144 is not in contact with lower sash 108. In moving the retention assembly 140,142,144 from the position shown in FIG. 48 to the position shown in FIG. 49, one may manually grasp the retention assembly 140,142,144 and move it out of contact with sash 108.

Figure 50:
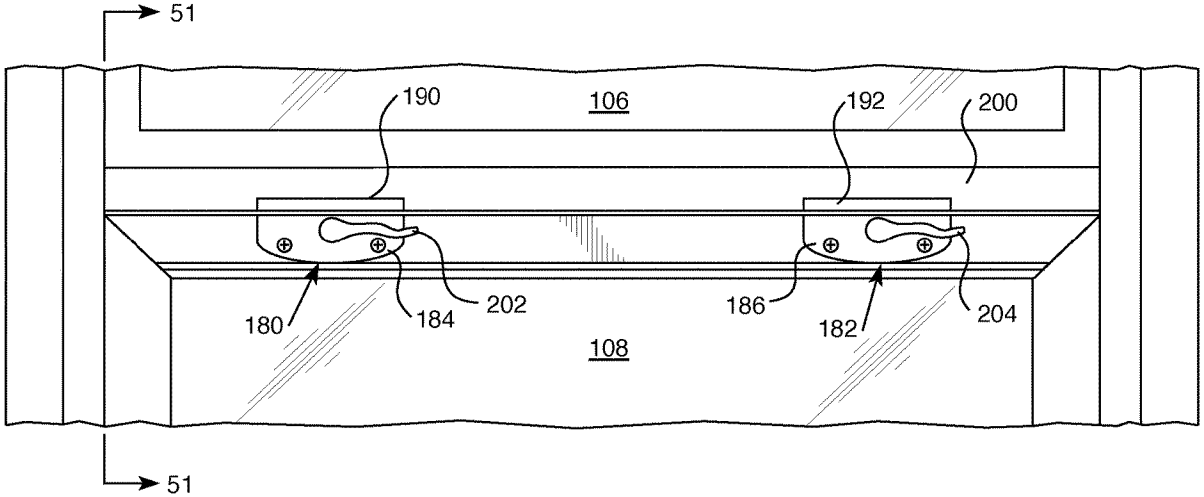
FIG. 50 shows a partial view of the lower sash showing two lock and keeper assemblies.
Figure 51:
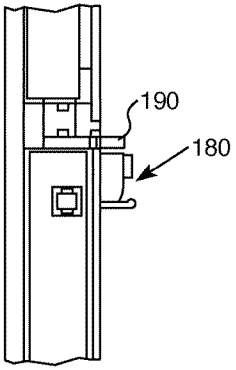
FIG. 51 is a cross-sectional view taken through 51-51 of FIG. 50.

FIGS. 50 and 51 show details of a form of window lock wherein the locks 180 and 182 have a lock portion 184,186 secured to the lower sash 108 and associated keeper portions 190,192 secured to fixed meeting rail 200. Rotation of the handles 202,204 in a first direction will lock the locks and rotation of the handles 202,204 in the opposite direction will unlock the locks.

Figure 52:
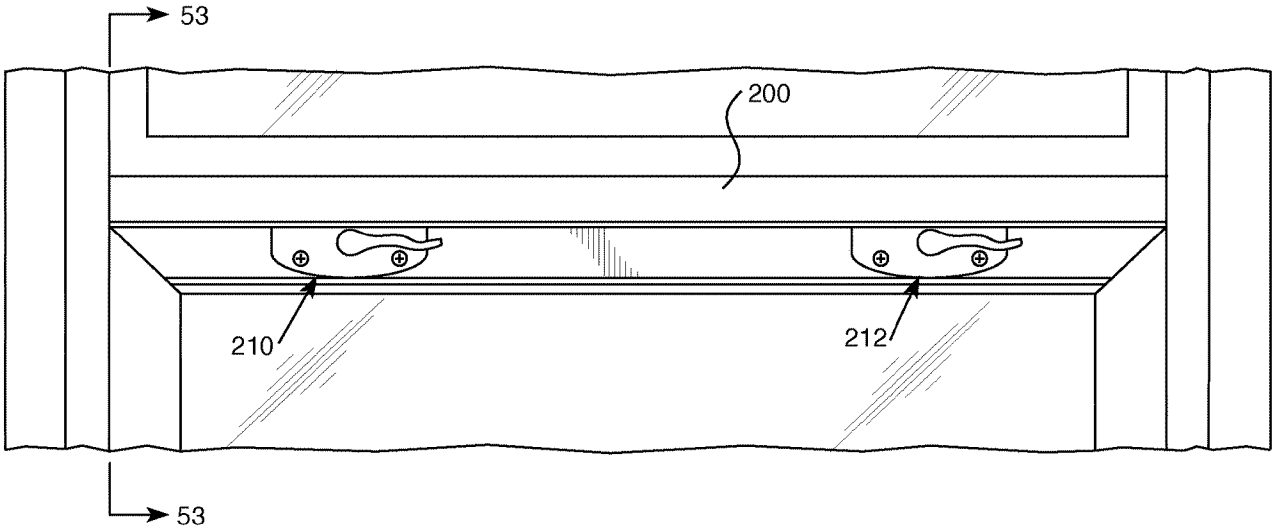
FIG. 52 is a partial view showing the lower sash with a keeperless lock.
Figure 53:
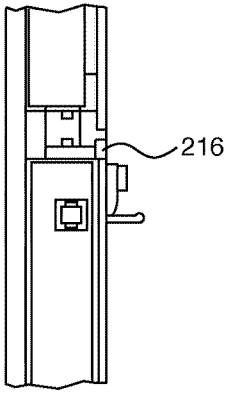
FIG. 53 is a cross-sectional view taken through 53-53 of FIG. 52 showing a portion of the keeperless lock and the recess which it engages when in locking position.

Referring to FIGS. 52 and 53, locks 210,212 do not have an associated keeper but, rather, engage a downwardly open channel or slot 216 in the fixed meeting rail 200 for locking and unlocking the window. The slot 216 may be created by milling or extruding, for example.

Figure 54A:
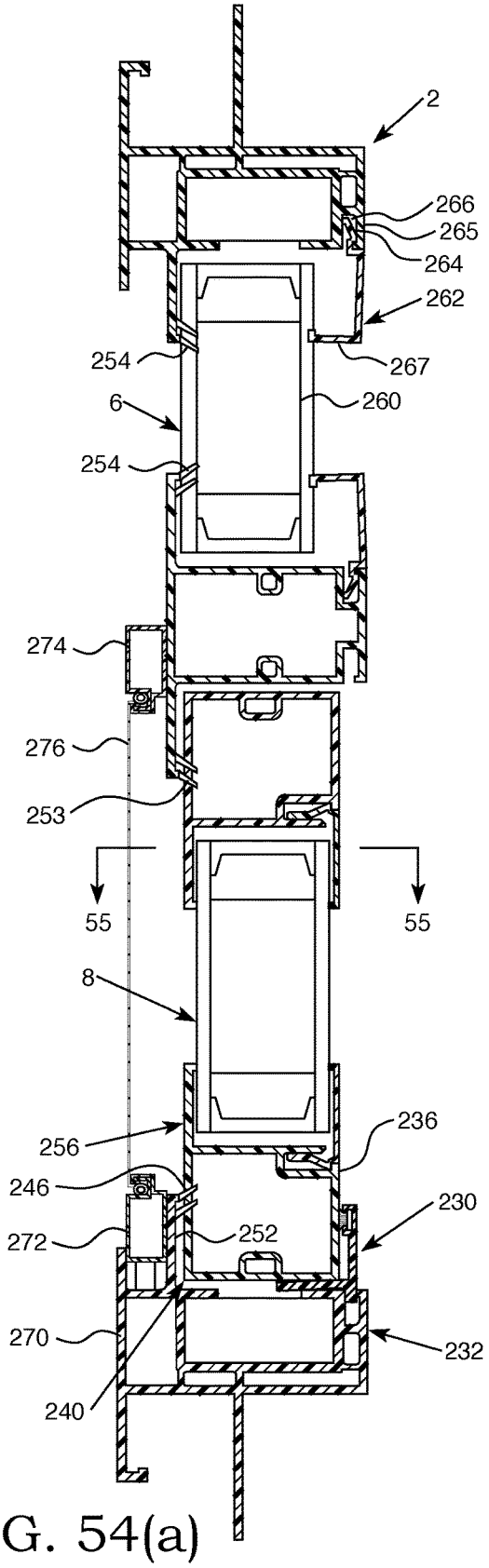
FIG. 54 (*a*) shows a cross-section of a vertical assembly of a vinyl frame window, such as the single hung window shown in FIGS. 1 through 6.
Figure 54B:
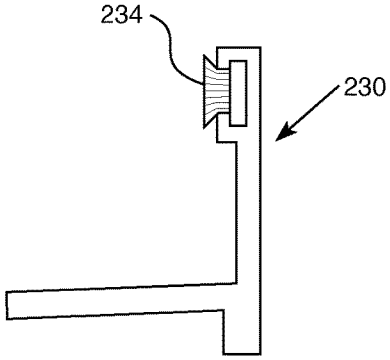

Referring now in greater detail to FIGS. 54 (*a*), 54 (*b*) and 55, some additional features of the invention will be considered. These figures show a vinyl frame with the upper fixed lite of glass 6 and lower sash 8 are shown in phantom and of reduced linear extent for convenience of illustration.

Referring to the lower portion of FIGS. 54 (*a*) and 54 (*b*), there is shown an insert 230 within which the weatherstripping 234 is received. The sill contains an upwardly open elongated channel. The weatherstripping 234 is in intimate contact with interior facing portion 236 of sash 256.

Referring to the outwardly facing portion of frame 270, there is shown in end view, a coextruded seal 246 which seals against an outer surface 252 of sash 256 which in the form shown is made of vinyl. The sealing bead 246 is coextruded with frame portion 270. This feature serves to provide for efficient creation and positioning of the sealing bead 246 member without requiring separate manufacturing and handling of the seal. Similar coextruded seals are shown generally at 252, 253, 254 and 256 with 254 and 256 sealing against the exterior surface of the upper fixed lite of glass 260 and seals 246 and 253 sealing against outer surface of sash 236.

It will be appreciated that both the coextruded seal and the framing and the resinous plastic material with which it is coextruded may be of the same material or a different material. A preferred material is flexible polyvinyl chloride.

Another feature of the present invention is shown in FIG. 54(*a*). This feature shows a cross-section of one of the four sides of the frame. A glazing bead 262 has an upper extension 264 which extends into downwardly open frame channel 266 of frame 2 which is partially defined by wall 265. This facilitates effective interengagement between the frame 2 and the glazing bead 262. A lower portion of glazing bead 262 has a leg 267 which is in intimate contact with glazing 260 to retain the glazing in place.

Referring to FIGS. 54 (*a*) and 55, an additional feature of the invention will be considered. Provided within the exterior of the lower sash frame is a channel defining portion 270 which defines an upwardly open channel within which a screen 272 having a frame 274 and screen material 276 is provided. It will be noted that vertical channels 290, 292 cooperate with a horizontal channel to provide effective retention of the screen. With this retention on three sides of the screen frame and the absence of a channel adjacent, the upper portion of the screen frame 274 (FIG. 54 (*a*)), the screen may be slid upwards for egress and exterior access. Once the sash 8 is rotated inwardly, the screen frame 274 may readily be removed for cleaning or replacement.

Figure 55:
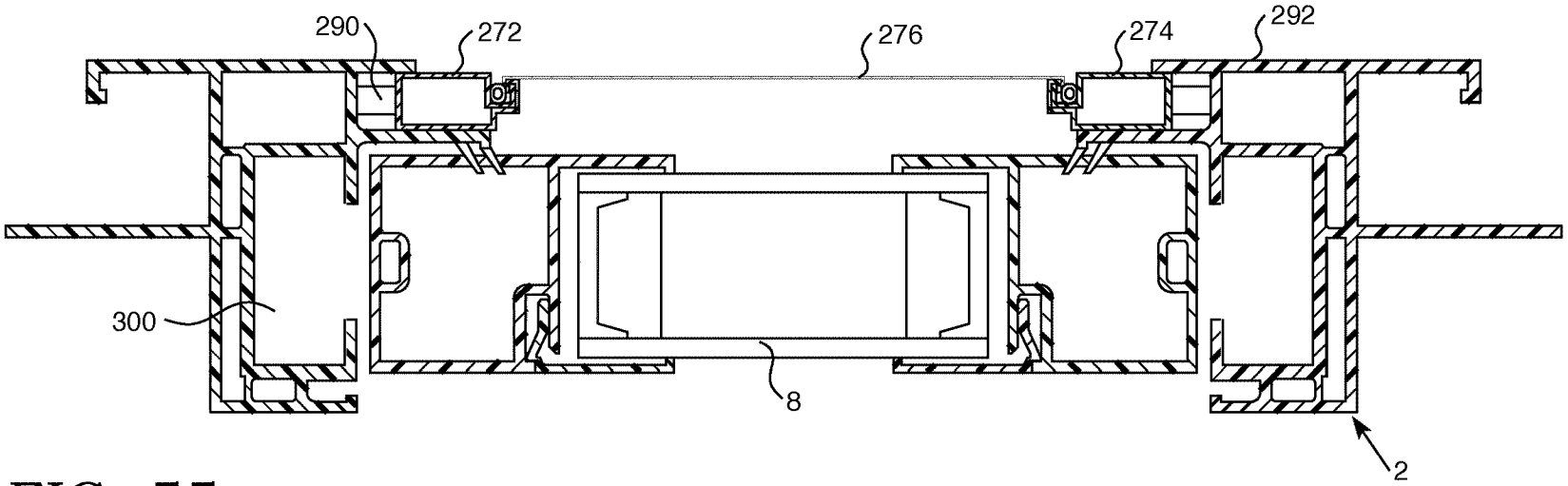
FIG. 55 shows a horizontal cross-section of the window of FIG. 54 (*a*) taken through 55-55.

As shown in FIG. 55, a pocket 300 for receipt of the balance system is provided.

Figure 56A:
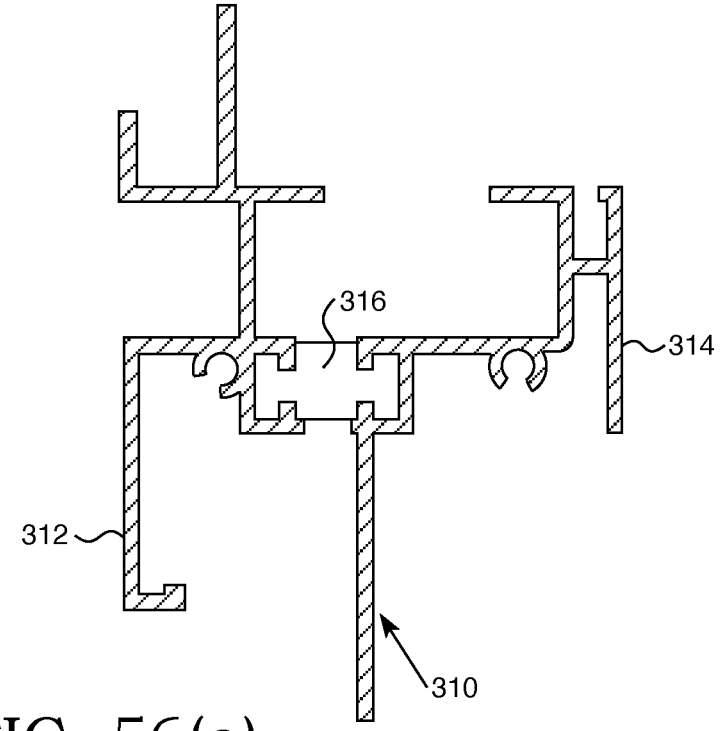
FIG. 56 (*a*) shows a cross-section of a jamb frame composed of a suitable metal, such as aluminum.
Figure 56B:
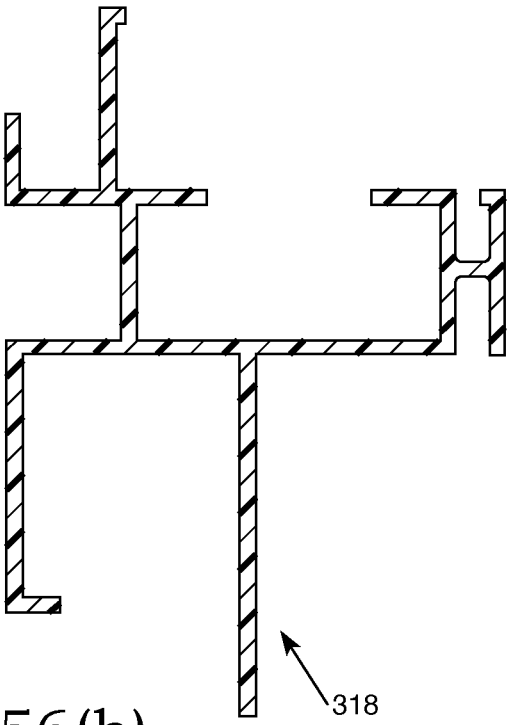

Referring to FIG. 56 (*a*), there is shown another embodiment of the frame 310 which is made of aluminum and has two sections 312,314 which are separated by a thermal break 316 to resist thermal conduction between the two sections 312,314.

FIG. 56 (*b*) illustrates the use of the invention in connection with the use of fiberglass and shows a cross-section of a pultruded jamb frame.

Referring to FIGS. 57 through 62, there is shown a movable sash 348 within which is secured a glass lite. The adjacent surrounding window frame 360 is secured to the sash frame 350 by a lock 354 which, in the form shown has a rotatable handle 356 to facilitate locking and unlocking the window. An outer frame 360 is provided with jambs 361, 363.

Referring to FIGS. 63 through 66, details regarding the positioning of the sash 346 will be considered. As shown in FIGS. 58 through 62, the sash 346 is in closed position.

The sash retention elements which will be described in greater detail hereinafter are secured adjacent the outer edges of the frame of sash 346.

Figure 58:
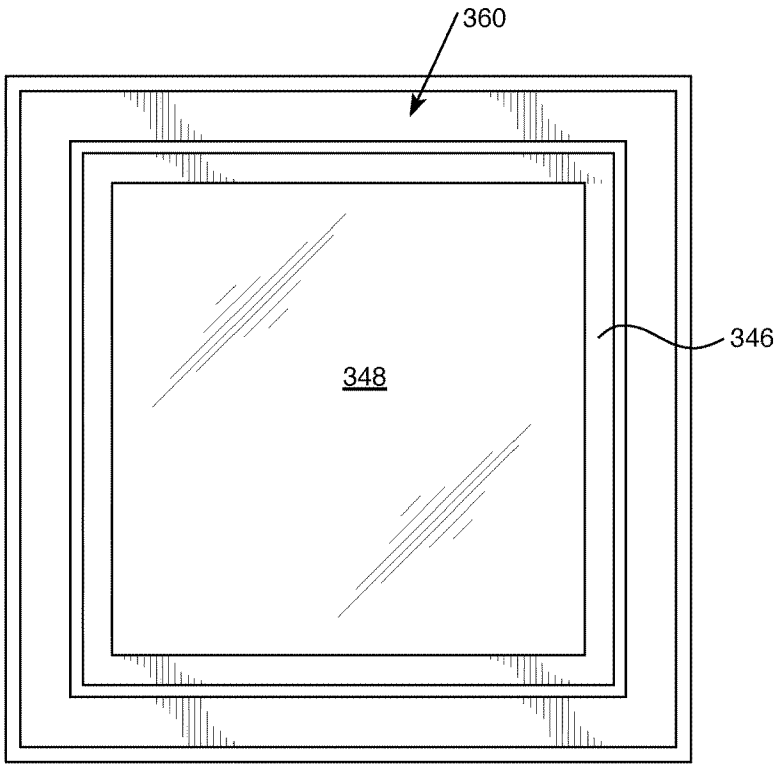
FIG. 58 is an exterior view of the window of FIG. 57.
Figure 57:
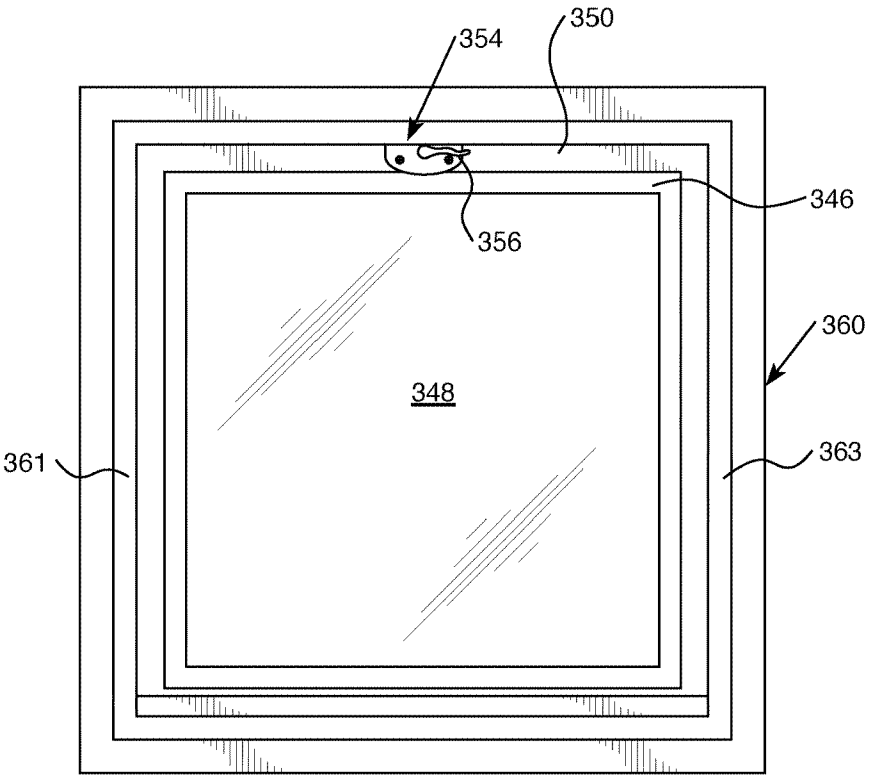
FIG. 57 is an interior elevational view of a window structured to be in underlying position with respect to an upper fixed lite of glass or positioned within a building wall with or without adjacent windows. It is also designed so as to have the operating hardware which controls the positioning of the sash generally concealed from view.
Figure 59:
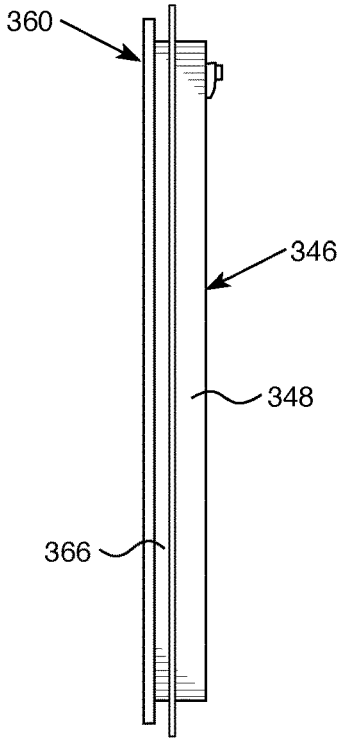
FIG. 59 is a left side elevational view of the window of FIG. 57.
Figure 60:
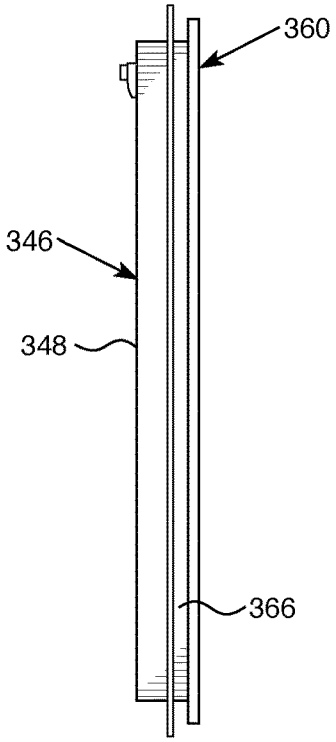
FIG. 60 is a right side elevational view of the window of FIG. 57.
Figure 61:
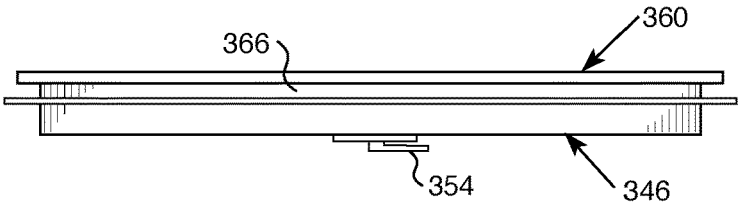
FIG. 61 is a top elevational view of the window of FIG. 57.
Figure 62:
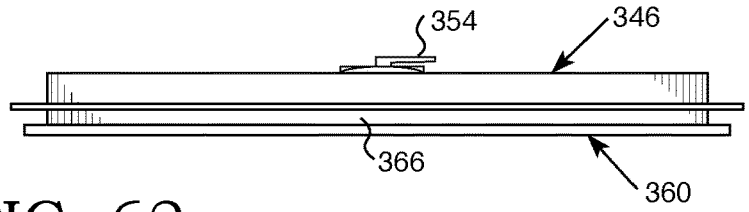
FIG. 62 is a bottom elevational view of the window of FIG. 57.
Figure 63:
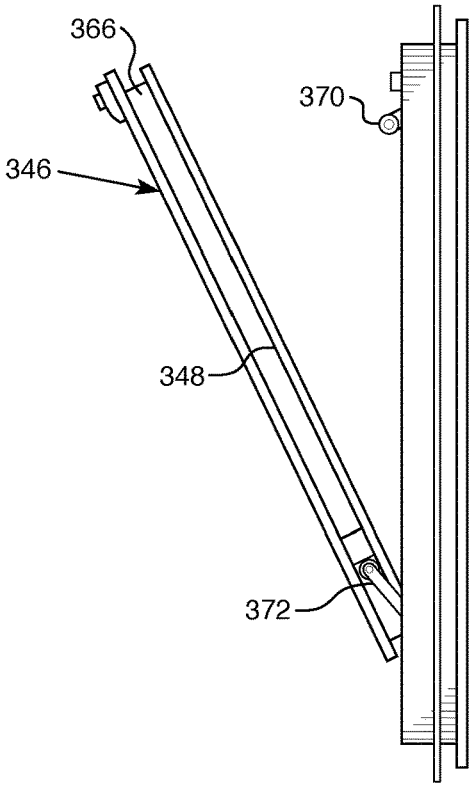
FIG. 63 is a right side elevational view of the window of FIG. 57 showing the sash extending inwardly into the building so as to facilitate cleaning of the exterior surface of the glass lite.

Referring to FIG. 63, there is shown the window with the sash 346 in the open position such that the inner surface of window pane 348 may be cleaned from the interior of the building. The sash 346 has been rotated generally about its lower portion so as to extend into the interior of the building. Each vertical frame or jamb portion 361,363 (FIG. 57) has secured to an upper sash retaining member 370 and a lower sash retaining member 372 which may be substantially identical to those shown, for example, as elements 82,90 in FIG. 25(*a*). The retaining members 370, 372 serve to facilitate positioning of the sash 346 in closed position such as shown in FIGS. 57 and 58. They also provide for engagement of sash retaining member 372 with outer lateral portions 366 of sash 346 and manual disengagement of sash retaining member 370 when it is desired to rotate to the open position shown in FIG. 63.

Figure 64:
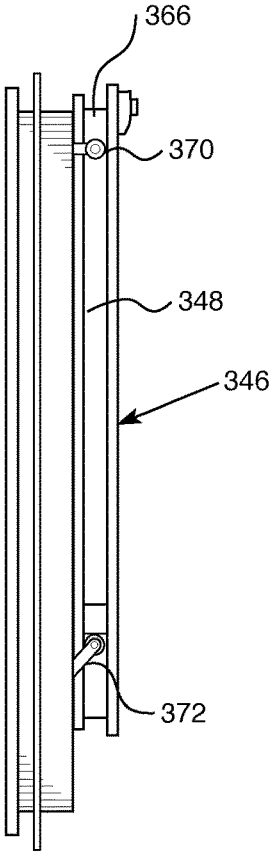
FIG. 64 is an elevational view of the window of FIG. 57 showing the sash moved upwardly so as to provide a vent opening in a generally vertical orientation.
Figure 65:
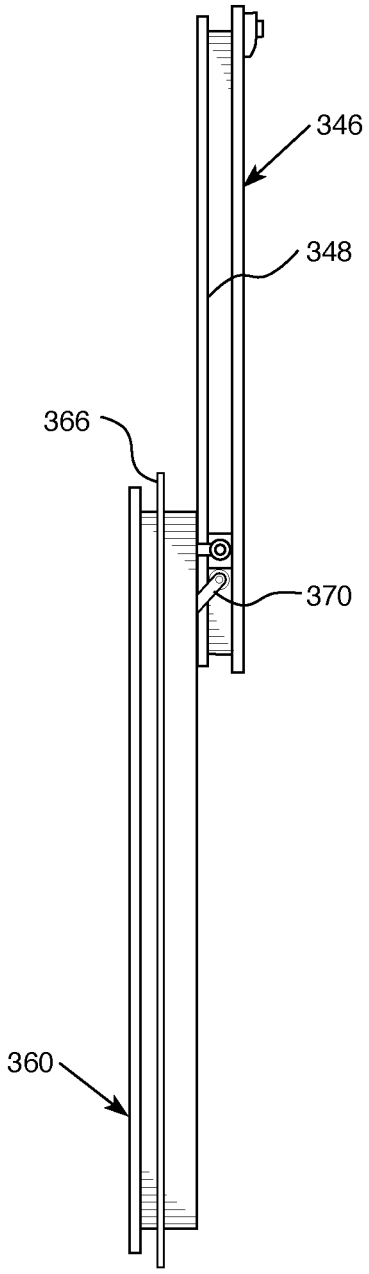
FIG. 65 is an elevational view of the window of FIG. 57 showing the sash in a generally vertical orientation in a full open position.

Referring to FIG. 64, the sash 346 has been moved by translation generally vertically to establish an open position with sash retaining members 370,372 being positioned closely adjacent to each other. FIG. 65 shows the sash 346 having been translated to the full open position.

Figure 66:
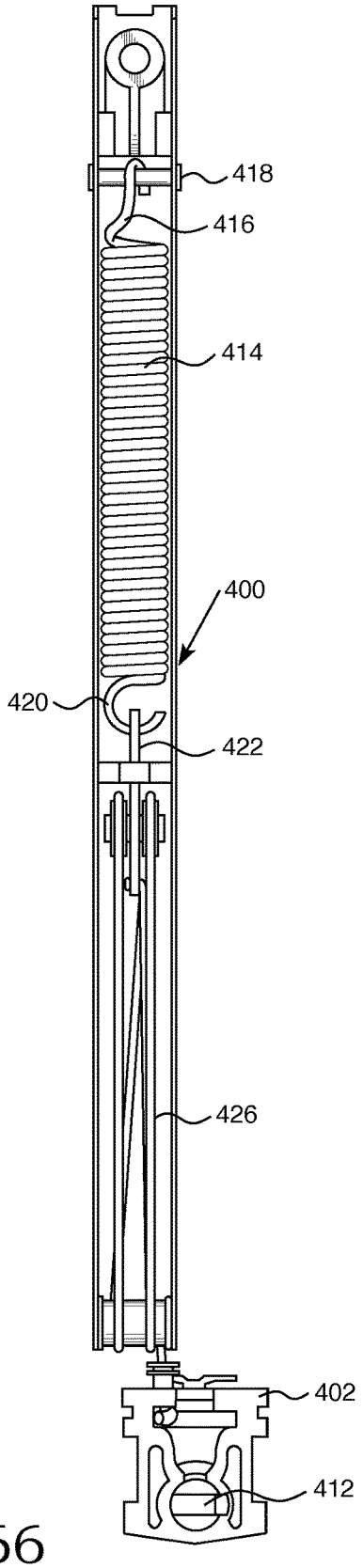
FIG. 66 shows in cross-section a form of balance which is incorporated into both jambs so as to effect efficient control of the sash.
Figure 67:
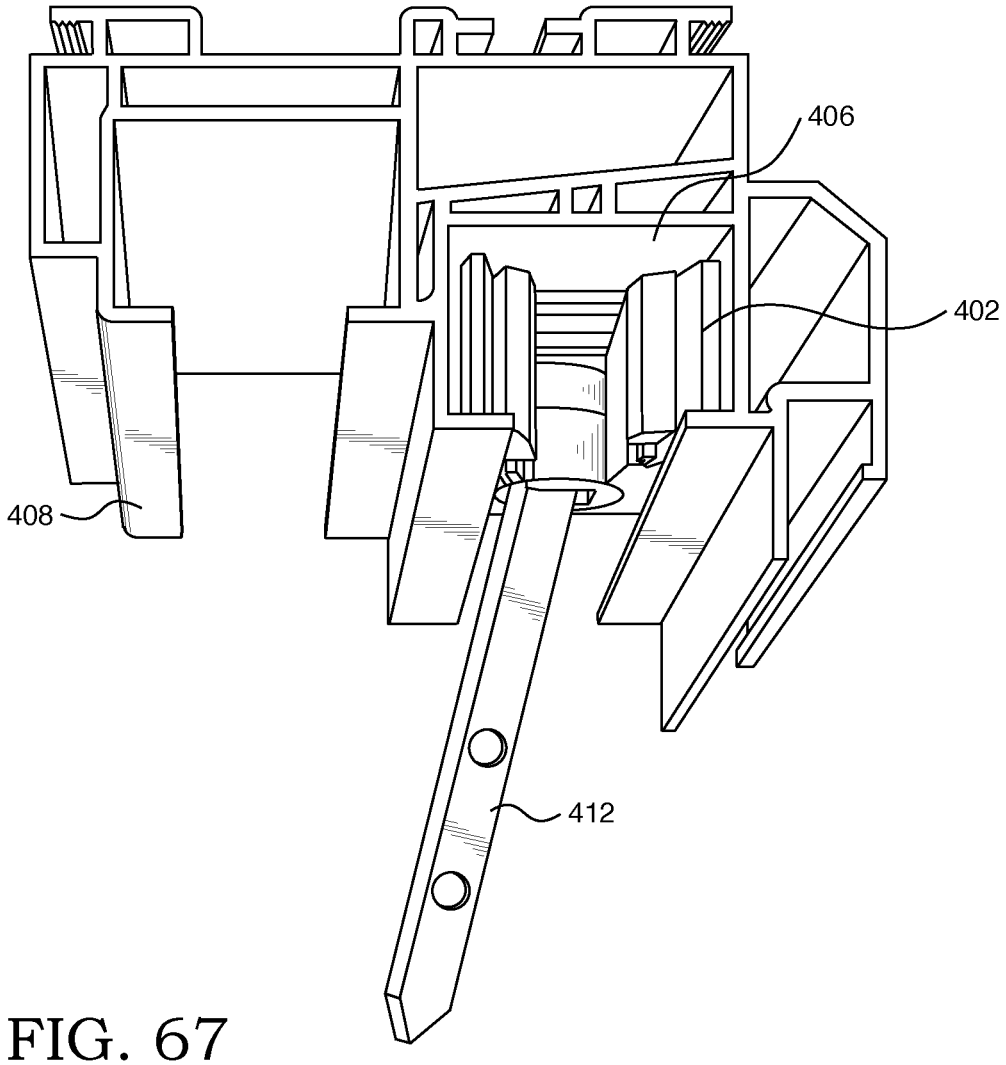
FIG. 67 shows a section of the jamb within which is positioned the balance shoe which, in turn, receives the sash pivot bar within an opening within the balance shoe.

Referring to FIGS. 66 and 67, there is shown a balance 400 with a balance shoe 402 which is received within a pocket of the jamb with a sash pivot bar extending into the balance shoe 402. The balance shoe 402 is received within a pocket 406 of jamb 408 and is interengaged with sash pivot bar 412. When the sash moves, the pivot bar 412 rotates thereby effecting expansion of the shoe 402 and providing effective braking.

As shown in FIG. 66, the balance 400 has a spring 414 which, in the form shown, is a coil spring having an end 416 secured to transverse pin 418 at the upper end. The lower end of spring has a portion 420 engaged with opening 422 of the lower end which has an elongated flexible cord 426 which is operatively associated with the balance shoe 402. In this manner, as the window is moved out of its lowermost position, balances which are located in both jambs of the window, serves to control and stabilize movement.

Figure 68:
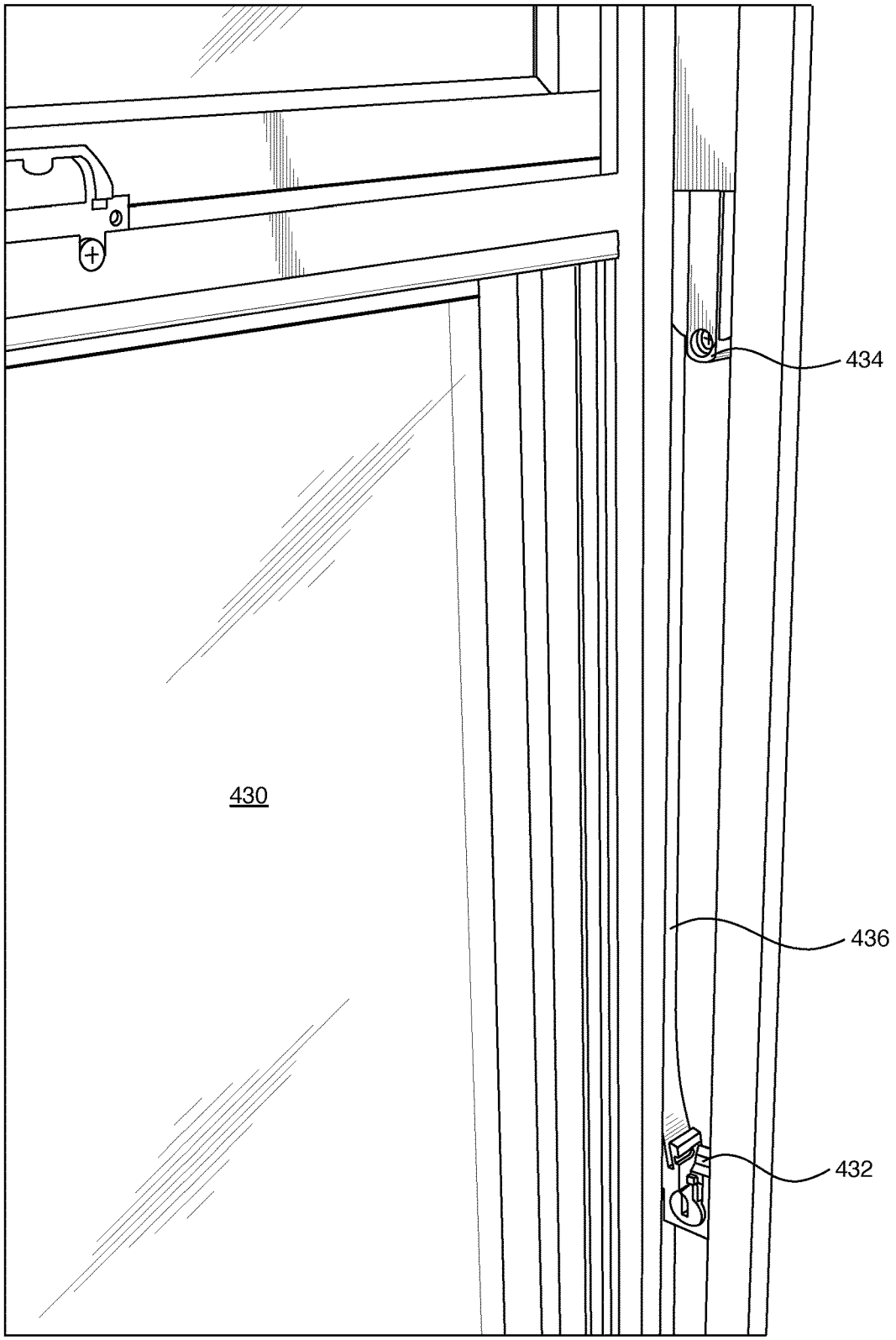
FIG. 68 is a perspective view partially in section showing the balance.

FIG. 68 shows the sash window with the balance block 432 in place in an upper extremity 434 of the balance connected to the block. This provides a constant force balance which is essentially a coil spring.

It will appreciated, therefore, that the present invention provides a single hung window with an upper fixed lite of glass overlying a generally coplanar movable lower sash with the upper fixed lite of glass and lower sash being generally coplanar. The invention accomplishes this while permitting multiple positions of the lower sash including closed, vent opening, vertically elevated to provide a full open position and internally rotated to permit cleaning of the exterior surface of the sash from the interior of the building. Various alternate means for securing the sash in these positions are disclosed. If desired, the lower sash may be employed alone without the upper fixed lite.

It will be appreciated that the present invention may be employed advantageously with a wide variety of materials such as synthetic resinous materials, metals and combinations thereof. For example, it may be employed with vinyl, fiberglass, wood and aluminum. Also, various methods of manufacture such as extrusion, coextrusion and pultrusion may be employed.

Whereas particular embodiments of the invention have been described hereinbefore for purposes of illustration, it will be evident to those skilled in the art that numerous variations of the details may be made without departing from the invention as defined in the appended claims.

What is claimed is:

1. A single hung window comprising, a window frame, an upper fixed lite of glass secured to said window frame, a movable lower sash secured to said window frame, said lower sash being generally coplanar with said upper fixed lite of glass, a pair of lower sash retention elements each having a first end rotatably secured to an opposed window frame jamb, said lower sash retention elements being generally aligned with each other, said lower sash retention elements being engageable said lower sash, each said lower sash retention element having a roller secured to a second end of said lower sash retention element, each said lower sash retention element having its roller in engagement with said lower sash when said lower sash is in a vent open position, and each aid lower sash retention element having its roller being out of contact with said lower sash when said sash is in a cleaning position.

2. The single hung window of claim 1 including, said lower sash structured to assures a closed position, said vent position and a vertically elevated fully open position.

3. The single hung window of claim 2 including, said lower sash structured to assume an inwardly projecting cleaning position to facilitate cleaning the exterior surface of said lower sash.

4. The single hung window of claim 2 including, said lower sash structured to be engaged by said lower sash retention elements while in said closed position, said vent position and said fully open position.

5. The single hung window of claim 2 including, said lower sash in said vent position and said vertically elevated fully open position being engaged with said lower sash retention elements, and said lower sash in said vent position, and said vertically elevated fully open position projecting interiorly.

6. The single, hung window of claim 5 including, said lower sash when in said vent position and said vertically elevated open position being engaged with said lower sash retention elements.

7. The single hung window of claim 1 including, at least one of said window frame and said lower sash having sealing material coextruded thereto to provide a seal therebetween to resist air infiltration.

8. The single hung, window of claim 7 including, at least one of said window frame and said lower ash being composed of a resinous material.

9. The single hung window of claim 8 including, said at least one of said window frame and said lower sash being composed of a material different from said sealing material.

10. The single hung window of claim 1 including, said window frame having a fixed meeting rail and at least one lock securing said lower sash thereto when said lower sash is in a closed position, said lower sash retention elements disposed below the level of said lock.

11. The single hung window of claim 10 including, said lock having one portion secured to said fixed meeting rail and another portion secured to said lower sash.

12. The single hung window of claim 11 including, said lock having a lock portion and a cooperating keeper portion.

13. The single hung window of claim 10 including, said fixed meeting rail having a downwardly open slot, and said lock portion being secured to said lower sash and cooperating with said generally open slot to secure said lower sash in closed position.

14. The single hung window of claim 1 including, said lower sash having a balance system secured within each window frame jamb operatively associated with said lower sash.

15. The single hung window of claim 14 including, said balance system having an elongated first link rotatably secured to an anchor block which is secured to said lower sash, and said first link is rotatably secured to a fixed shoe which is disposed within said window frame jamb.

16. The single hung window of claim 15 including, a second shoe disposed within said window frame jamb adjacent to said first shoe, and a second link rotatable connected to said first link and to said second shoe.

17. The single hung window of claim 14 including, said balance system having a block fixedly secured within a portion of said window frame and a pivot bar projecting therefrom, and said pivot bar being engaged within a recess in said lower sash.

18. The single hung window of claim 17 including, a said window balance system being disposed within each jamb of said window frame.

19. The single hung window of claim 14 including, said balance system having a lower assembly including a constant force balance shoe disposed within a jamb of said, window and having a block secured to said window with a first connecting arm pivotally secured to said constant force balance shoe and to said block.

20. The single hung window of claim 19 including, a second shoe disposed within, said jamb spaced from said constant force balance shoe and having a second connecting arm rotatably secured to said first connecting arm.

21. The single hung window of claim 1 including, said movable lower sash having at least one glass lite.

22. The single hung window of claim 1 including, said window frame having channels secured thereto for receiving a screen.

23. The single hung window of claim 22 including, said channels being exterior portions of the frame.

24. The single hung window of claim 23 including, said channels being so structured as to facilitate removal of said screen from the interior of a building.

25. The single hung window of claim 1 including, a fixed block secured to a portion of said window frame, a connecting arm having one end rotatably secured to said block, and said sash engaging roller rotatably secured to the other end of said connecting arm.

26. The single hung window of claim 25 including, said fixed block being disposed within a recess in a jamb of said window frame.

27. The single hung window of claim 26 including, said sash retention elements being structured to engage said lower sash.

28. The single hung window of claim 1 including, said window frame having a glazing bead receiving channel, a glazing bead having a first portion extending into said glazing bead receiving channel, and said glazing bead having a second portion in contact with said lite of glass for securing said fixed lite in place.

29. The single hung window of claim 28 including, said first portion being oriented generally perpendicular to said second portion.

30. The single hung window of claim 29 including, an inter-engagement between said first portion and said glazing bead receiving channel effecting intimate contact between said second portion and said fixed lite.

31. The single hung window of claim 30 including, said second portion being generally perpendicular to said fixed lite.

* * * * *